US010095161B2

(12) United States Patent
Takeuchi et al.

(10) Patent No.: US 10,095,161 B2
(45) Date of Patent: Oct. 9, 2018

(54) ACCOMMODATING CONTAINER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Toshiaki Takeuchi, Susono (JP); Yoshiyuki Batori, Suntou-gun (JP); Ryuta Murakami, Suntou-gun (JP); Daisuke Makiguchi, Izunokuni (JP); Gosuke Goto, Kawasaki (JP); Makoto Tokudome, Yokohama (JP); Yu Fukasawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/437,817

(22) Filed: Feb. 21, 2017

(65) Prior Publication Data

US 2017/0168422 A1 Jun. 15, 2017

Related U.S. Application Data

(62) Division of application No. 14/161,802, filed on Jan. 23, 2014, now Pat. No. 9,599,932.

(30) Foreign Application Priority Data

Jan. 31, 2013 (JP) ..... 2013-017477
Nov. 28, 2013 (JP) ..... 2013-246516

(51) Int. Cl.
*G03G 15/08* (2006.01)
*G03G 21/18* (2006.01)

(52) U.S. Cl.
CPC ..... *G03G 15/0881* (2013.01); *G03G 15/0865* (2013.01); *G03G 21/18* (2013.01)

(58) Field of Classification Search
CPC ..... G03G 15/0881; G03G 15/0872; G03G 15/0865; G03G 15/0882; G03G 15/0889; G03G 15/0841
See application file for complete search history.

(56) References Cited

U.S. PATENT DOCUMENTS 5,911,096 A 6/1999 Batori et al.
5,920,753 A 7/1999 Sasaki et al.
(Continued)

FOREIGN PATENT DOCUMENTS

JP 1128352 U * 9/1989
JP H05-197288 A 8/1993
(Continued)

OTHER PUBLICATIONS

English machine translation of JP 1-128352.*
Office Action in Chinese Patent Application No. 201410043001.4, dated Apr. 22, 2016 (with English translation).

*Primary Examiner* — Walter L Lindsay, Jr.
*Assistant Examiner* — Arlene Heredia Ocasio
(74) *Attorney, Agent, or Firm* — Fitzpatrick, Cella, Harper & Scinto

(57) ABSTRACT

An accommodating container includes: an accommodating chamber, provided with an opening, for accommodating a developer; a seal member for unsealably sealing the opening; and a rotatable member rotatably supported inside the accommodating chamber. The seal member includes a sealing portion for sealing the opening, a connecting portion connected with the rotatable member, and at least one hole provided between the sealing portion and the connecting portion. The rotatable member includes a shaft portion and at least one projection extending in a direction of being spaced from the shaft portion. The hole and the projection
(Continued)

are provided to establish a non-overlapping positional relationship with respect to a direction along the shaft portion.

36 Claims, 19 Drawing Sheets

(56) References Cited

U.S. PATENT DOCUMENTS

| | | | |
|---|---|---|---|
| 5,930,562 | A | 7/1999 | Noda et al. |
| 5,937,237 | A | 8/1999 | Nonaka et al. |
| 5,940,658 | A | 8/1999 | Yokoi et al. |
| 6,075,957 | A | 6/2000 | Batori et al. |
| 6,101,348 | A | 8/2000 | Nonaka et al. |
| 6,131,007 | A | 10/2000 | Yamaguchi et al. |
| 6,275,668 | B1 | 8/2001 | Batori |
| 6,334,035 | B1 | 12/2001 | Abe et al. |
| 6,363,226 | B1 | 3/2002 | Batori |
| 6,714,746 | B2 | 3/2004 | Morioka et al. |
| 6,735,405 | B2 | 5/2004 | Yokoi et al. |
| 6,836,639 | B2 | 12/2004 | Karakama et al. |
| 6,898,392 | B2 | 5/2005 | Karakama et al. |
| 6,937,832 | B2 | 8/2005 | Sato et al. |
| 6,963,706 | B2 | 11/2005 | Morioka et al. |
| 6,987,938 | B2 | 1/2006 | Murakami et al. |
| 7,024,131 | B2 | 4/2006 | Komatsu et al. |
| 7,079,787 | B2 | 7/2006 | Ogino et al. |
| 7,127,192 | B2 | 10/2006 | Batori et al. |
| 7,136,604 | B2 | 11/2006 | Chadani et al. |
| 7,156,797 | B2 | 1/2007 | Komatsu et al. |
| 7,200,349 | B2 | 4/2007 | Sato et al. |
| 7,206,534 | B2 | 4/2007 | Murakami |
| 7,418,225 | B2 | 8/2008 | Morioka et al. |
| 7,558,514 | B2 | 7/2009 | Yamamura |
| 7,885,575 | B2 | 2/2011 | Batori et al. |
| 8,081,898 | B2 | 12/2011 | Batori et al. |
| 8,326,185 | B2 | 12/2012 | Asanuma et al. |
| 8,406,656 | B2 | 3/2013 | Batori et al. |
| 8,565,640 | B2 | 10/2013 | Batori et al. |
| 8,620,181 | B2 | 12/2013 | Murakami |
| 8,644,732 | B2 | 2/2014 | Kikuchi et al. |
| 8,676,085 | B1 | 3/2014 | Batori et al. |
| 9,423,722 | B2 | 8/2016 | Okuda |
| 2007/0196135 | A1 | 8/2007 | Fukuta |
| 2007/0280739 | A1 | 12/2007 | Tanaka |
| 2009/0162101 | A1* | 6/2009 | Yoshida ..... G03G 15/0877 399/254 |
| 2010/0028039 | A1 | 2/2010 | Abe et al. |
| 2010/0239305 | A1* | 9/2010 | Takagi ..... G03G 15/0862 399/99 |
| 2013/0272753 | A1 | 10/2013 | Fukasawa et al. |
| 2014/0003845 | A1 | 1/2014 | Tokudome et al. |
| 2014/0086620 | A1 | 3/2014 | Takeuchi et al. |
| 2014/0086621 | A1 | 3/2014 | Makiguchi et al. |
| 2014/0086632 | A1 | 3/2014 | Batori et al. |
| 2014/0093272 | A1 | 4/2014 | Matsumaru et al. |
| 2014/0105639 | A1 | 4/2014 | Kikuchi et al. |
| 2014/0126928 | A1 | 5/2014 | Batori et al. |
| 2014/0212181 | A1 | 7/2014 | Nakamura et al. |

FOREIGN PATENT DOCUMENTS

| | | | |
|---|---|---|---|
| JP | 2006-064740 | A | 3/2006 |
| JP | 2011-47981 | A | 3/2011 |

* cited by examiner (a)

(b)

ACCOMMODATING CONTAINER, PROCESS CARTRIDGE AND ELECTROPHOTOGRAPHIC IMAGE FORMING APPARATUS

FIELD OF THE INVENTION AND RELATED ART

The present invention relates to an accommodating container for accommodating a developer, a process cartridge, and an image forming apparatus.

Here, a main assembly for an electrophotographic image forming apparatus forms an image on a recording material (such as recording paper or an OHP sheet) by using the electrophotographic type. Examples of a main assembly of the electrophotographic image forming apparatus may include, e.g., an electrophotographic copying machine, an electrophotographic printer, a facsimile machine and a multi-function machine (multi-function printer), and the like.

Further, the process cartridge refers to a process cartridge prepared by integrally assembling an electrophotographic photosensitive drum and, as a process means actable on the electrophotographic photosensitive drum, at least one of a charging means, a developing means and a cleaning means into a cartridge. Then, this process cartridge is detachably mounted into the electrophotographic image forming apparatus main assembly.

Japanese Laid-Open Patent Application (JP-A) Hei 5-197288 and JP-A 2011-47981 disclose a developing device including a developing chamber including a developing roller and a feeding chamber, provided adjacently to the developing chamber, for feeding a developer to the developing chamber. Further, in the developing device, an opening is formed between the developing chamber and the feeding chamber and is sealed with a seal member. The seal member is mounted to an end portion of a rotatable member provided inside the feeding chamber, and when the rotatable member is rotated, the seal member is peeled off to expose the opening, so that the developer is movable.

According to such a constitution, a user can perform peeling-off of the seal member in interrelation with an operation of the feeding chamber without removing the seal member by the user himself (herself).

However, in such a constitution, in the case where a peripheral portion of the opening is constituted by a peripheral wall, a load for peeling a bonding portion between the seal member and the peripheral portion is required at a level more than expected in some cases.

For example, there is the case where a toner density is increased by vibration or the like of a developer accommodating container during transportation. In such a case, there is a need to increase capacity of a power source for peeling the seal member or to ensure part strength correspondingly to the increase in capacity of the power source. As a result, there is a possibility that the electrophotographic image forming apparatus is increased in size and cost.

SUMMARY OF THE INVENTION

A principal object of the present invention is to provide an accommodating container capable of reducing a load required to unseal a sheet member from a peripheral wall of an opening of an accommodating chamber.

According to an aspect of the present invention, there is provided an accommodating container comprising: an accommodating chamber, provided with an opening, for accommodating a developer; a seal member for unsealably sealing the opening; and a rotatable member rotatably supported inside the accommodating chamber, wherein the seal member includes a sealing portion for sealing the opening, a connecting portion connected with the rotatable member, and at least one hole provided between the sealing portion and the connecting portion, wherein the rotatable member includes a shaft portion and at least one projection extending in a direction of being spaced from the shaft portion, and wherein the hole and the projection are provided to establish a non-overlapping positional relationship with respect to a direction along the shaft portion.

According to another aspect of the present invention, there is provided an accommodating container comprising: an accommodating chamber, provided with an opening, for accommodating a developer; a seal member for unsealably sealing the opening; and a rotatable member rotatably supported inside the accommodating chamber, wherein the seal member includes a sealing portion for sealing the opening, a connecting portion connected with the rotatable member, and at least one slit provided between the sealing portion and the connecting portion, wherein the rotatable member includes a shaft portion and at least one projection extending in a direction of being spaced from the shaft portion, and wherein the hole and the projection are provided to establish a non-overlapping positional relationship with respect to a direction along the shaft portion.

According to the present invention, the load required to unseal the sheet member from the peripheral wall of the opening of the accommodating chamber is reduced.

These and other objects, features and advantages of the present invention will become more apparent upon a consideration of the following description of the preferred embodiments of the present invention taken in conjunction with the accompanying drawings.

Figure 6:
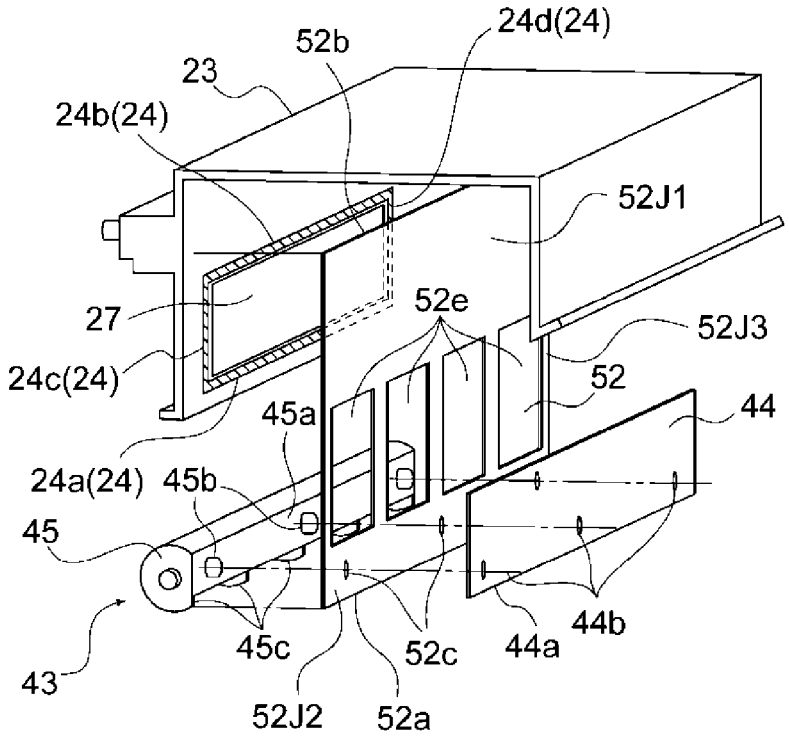
Figure 6:
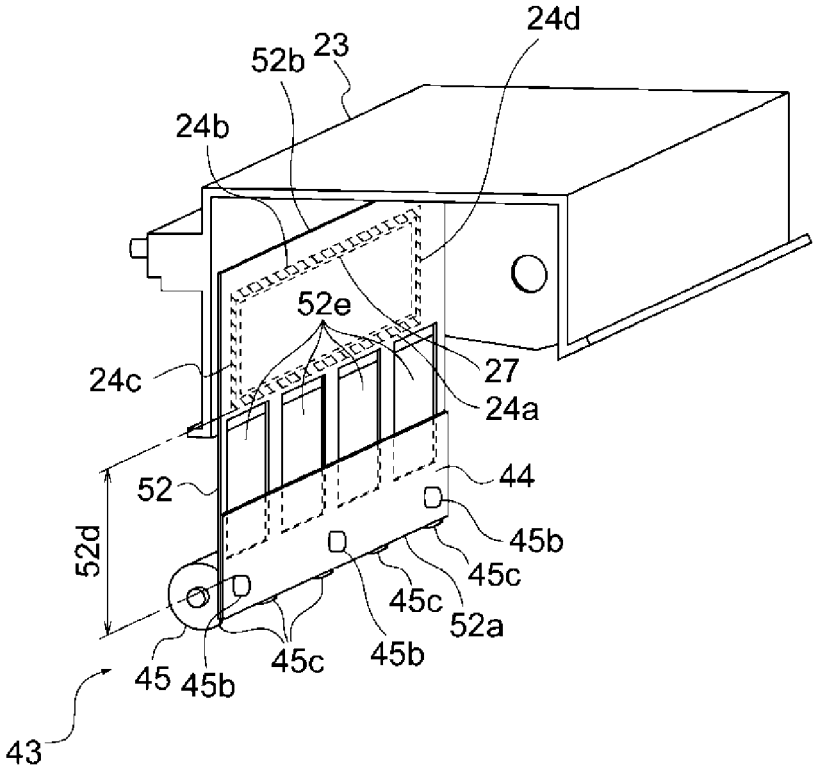

Parts (a) and (b) of FIG. 6 are an exploded perspective view showing a disassembled state of a feeding member and a developing container and a perspective illustration showing a bonding state of a seal member to the feeding member and the developing container, respectively.

Figure 7:
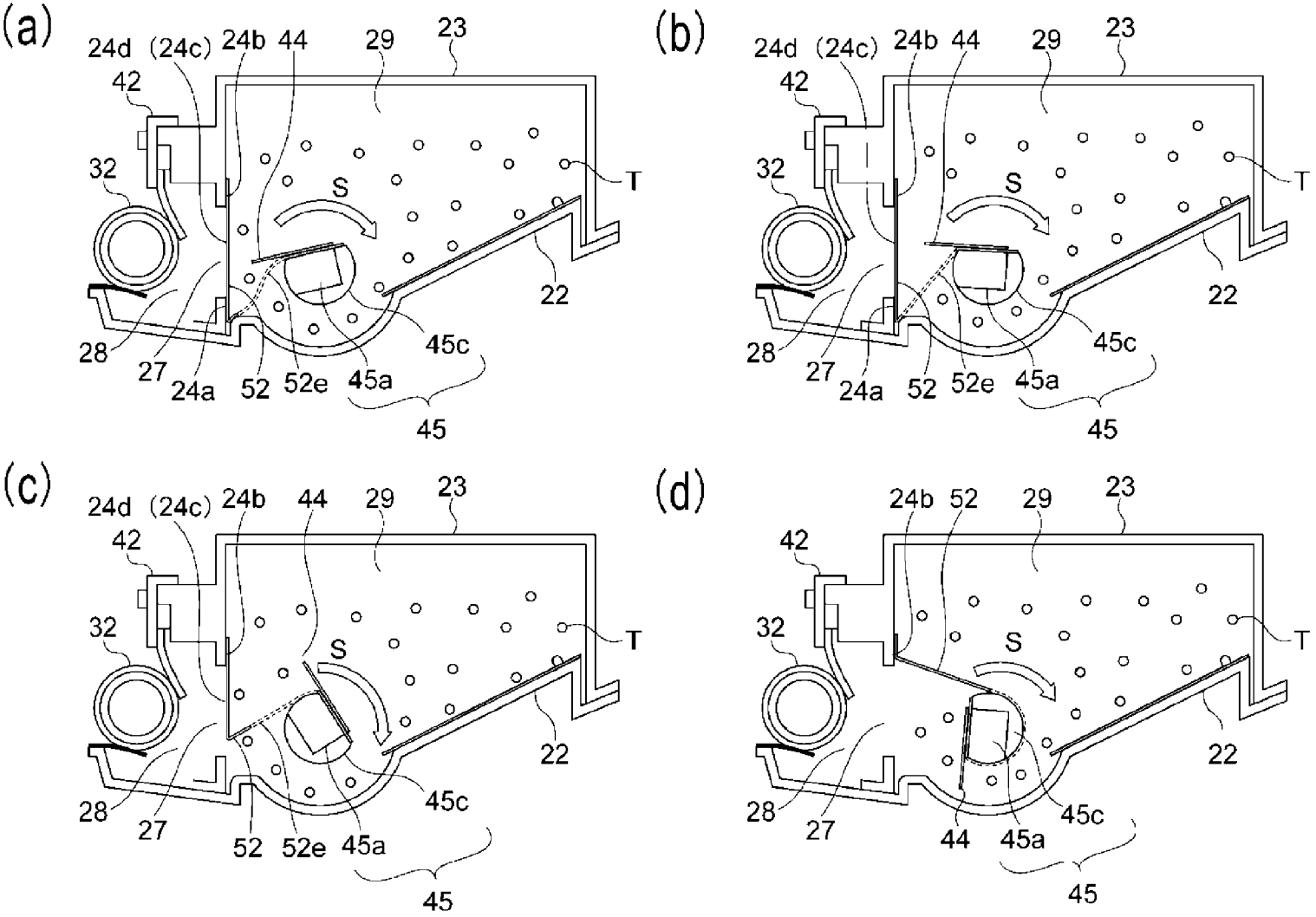

Parts (a) to (d) of FIG. 7 are sectional views showing a process in which the seal member gradually unseals an opening.

Figure 8:
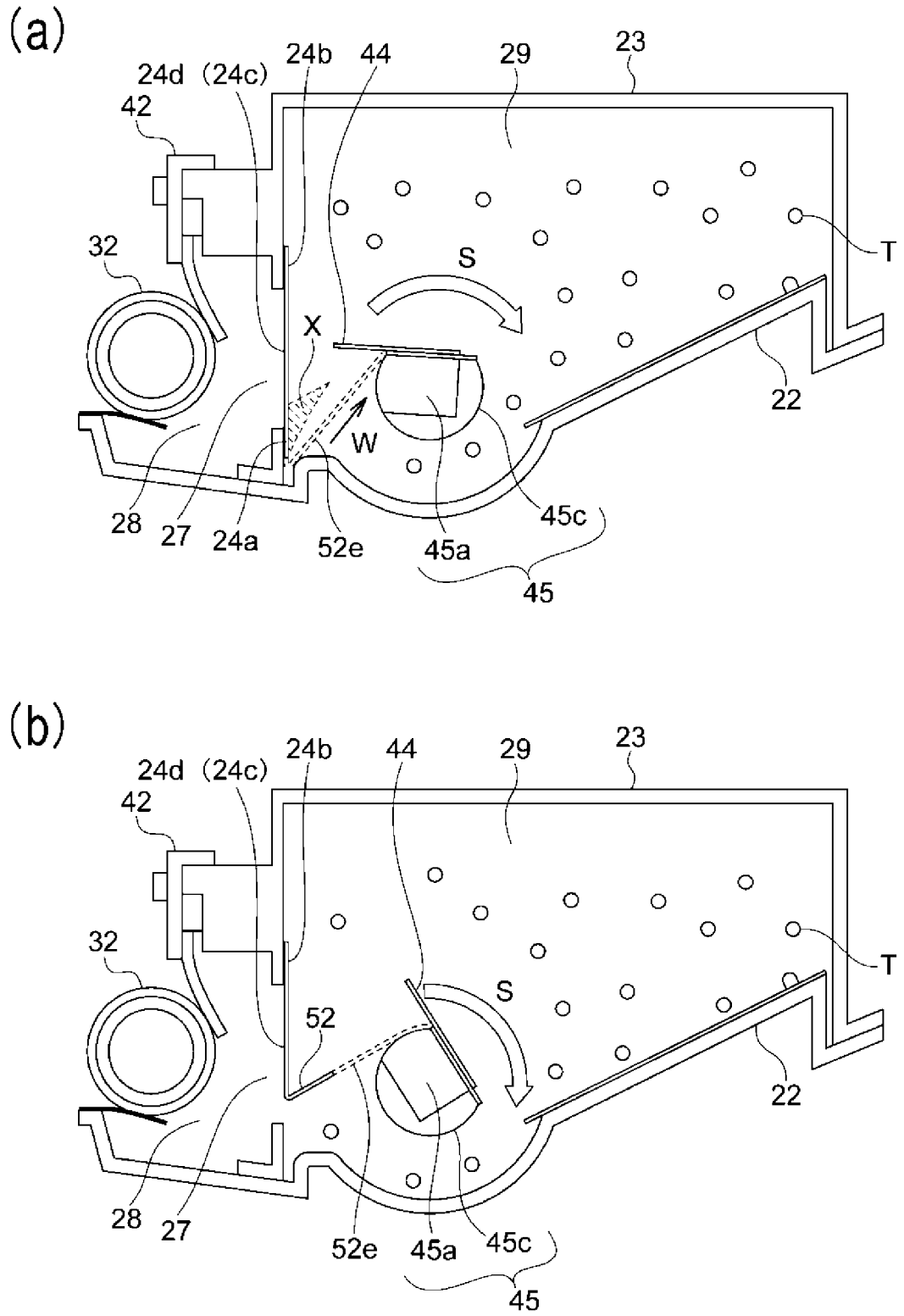

Parts (a) and (b) of FIG. 8 are sectional views showing a state of start of peeling of a first sealing portion and a state of the first sealing portion during the peeling, respectively.

Figure 9:
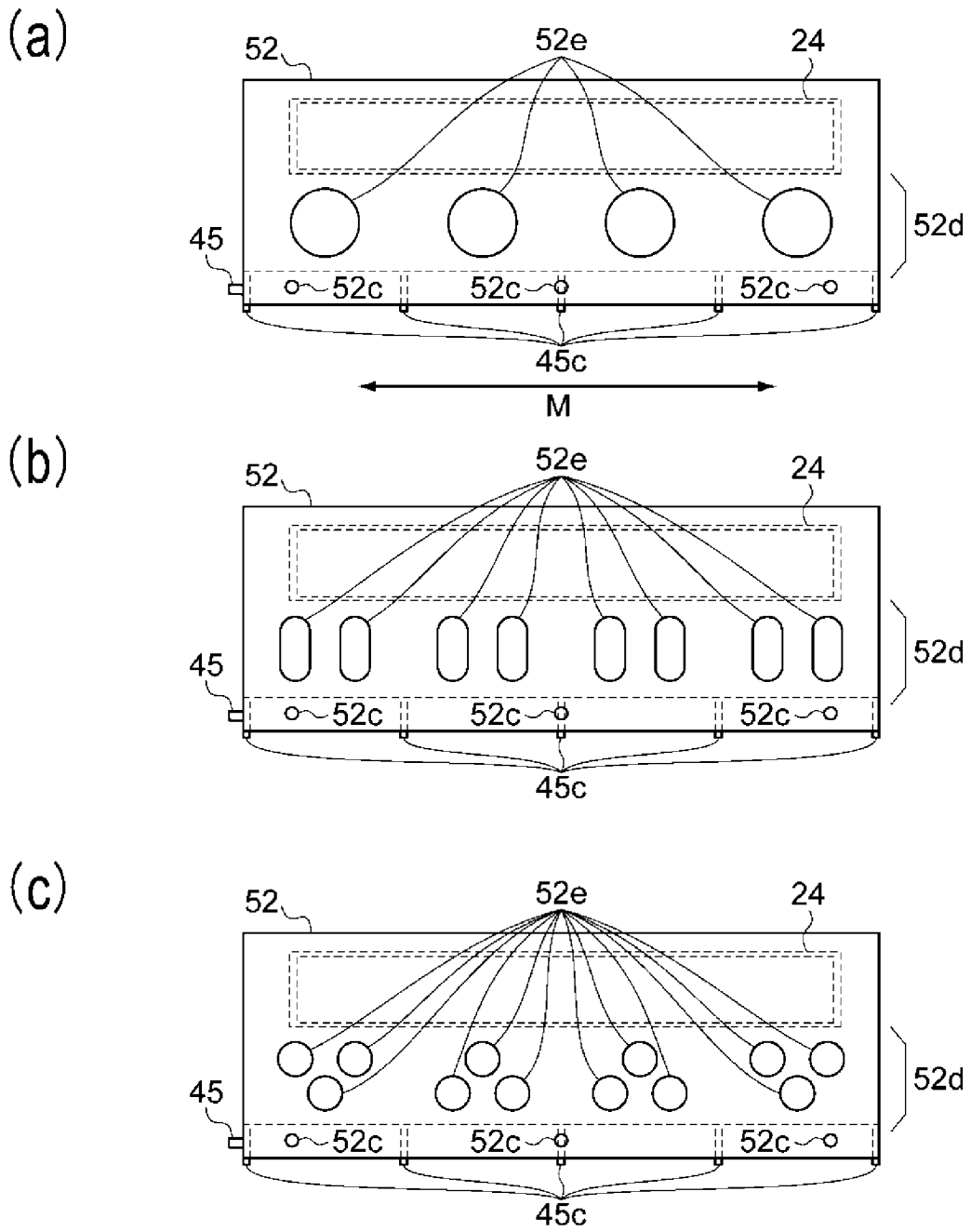

Parts (a), (b) and (c) of FIG. 9 are sectional views each showing holes of the seal member.

Figure 10:
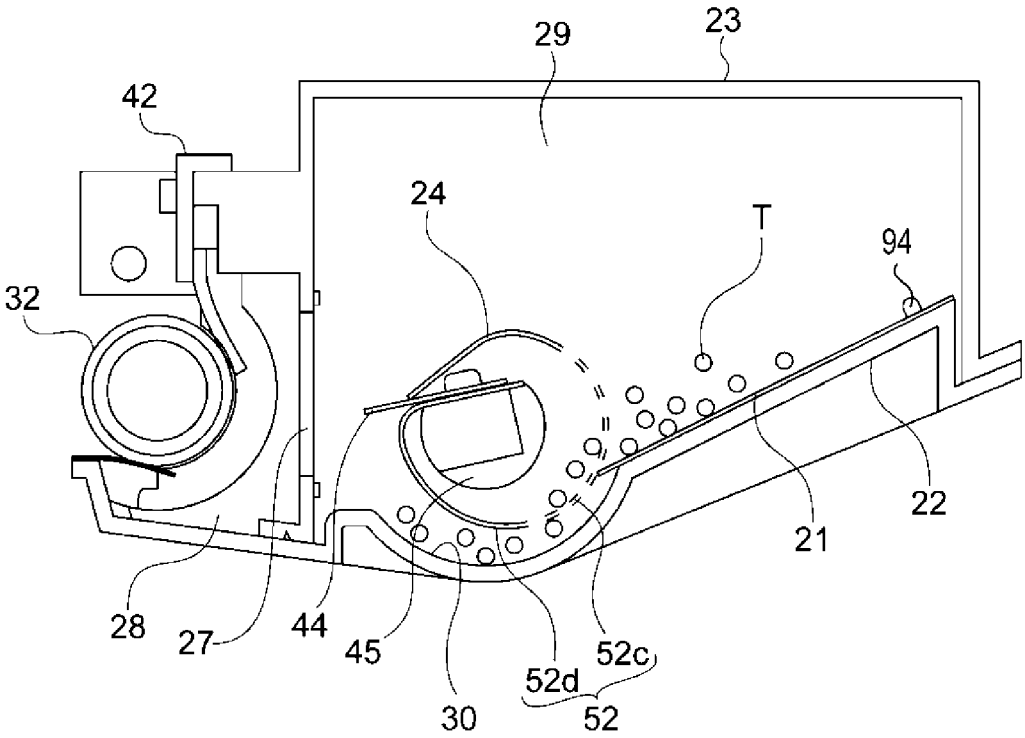

FIG. 10 is a sectional view showing a state in which a toner stagnated at a point of contact between the seal member and a vibrating sheet is moved into a stirring operation range through the holes of the seal member.

Figure 11:
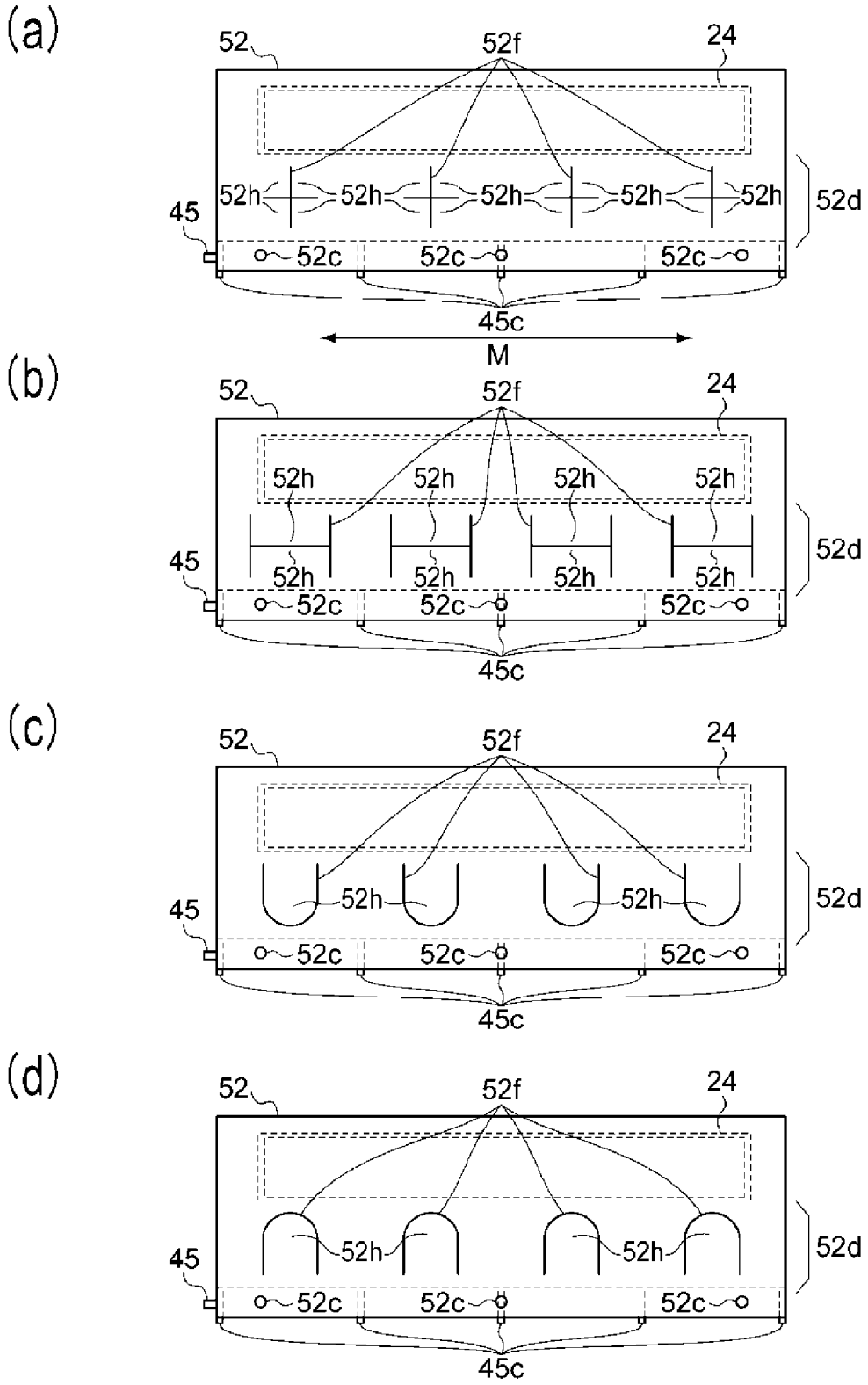

Parts (a) to (d) of FIG. 11 are plan views each showing slits of a seal member in Embodiment 2.

Figure 12:
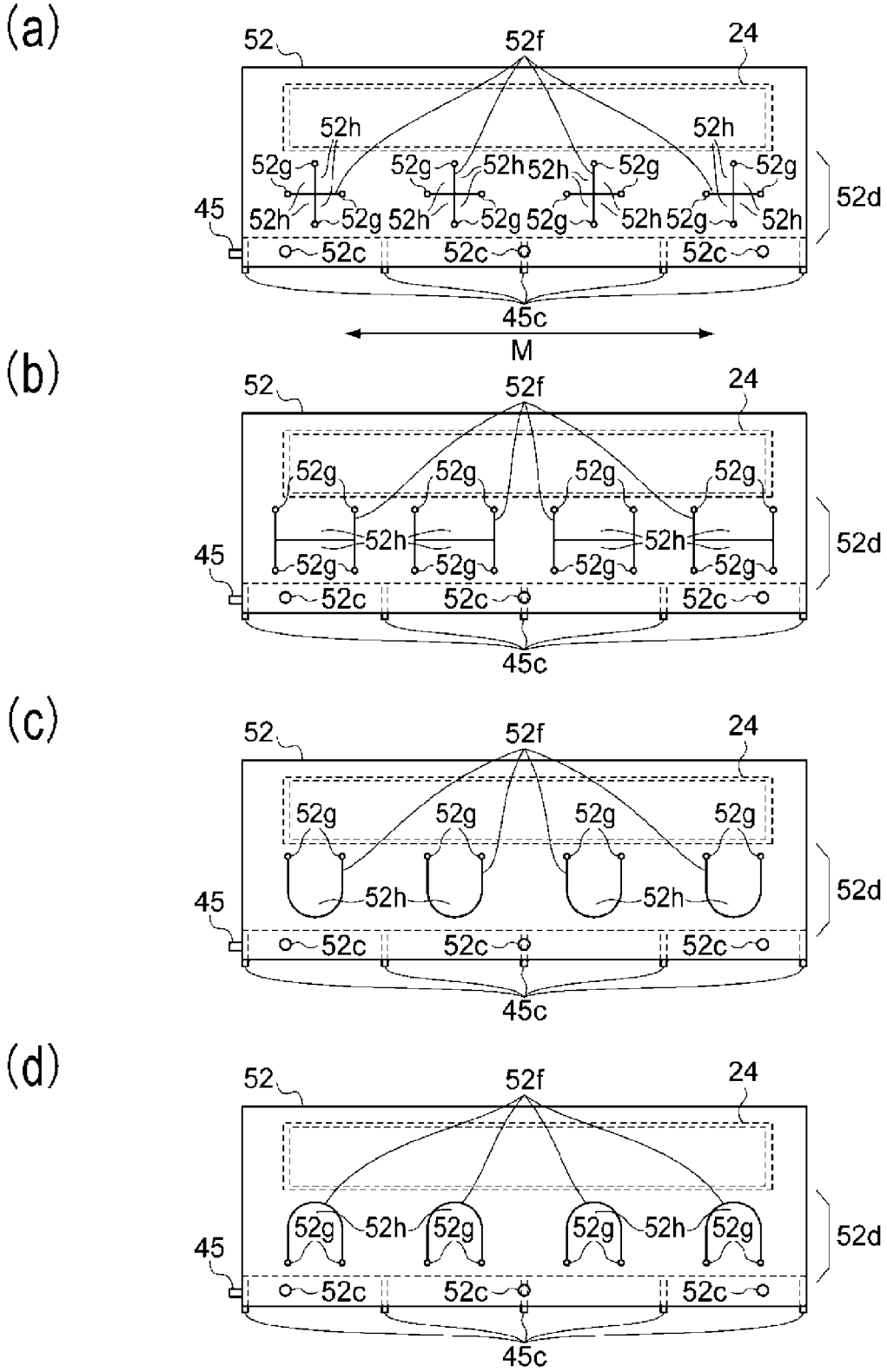

Parts (a) to (d) of FIG. 12 are plan views each showing slit of a seal member in a modified embodiment of Embodiment 2.

Figure 13:
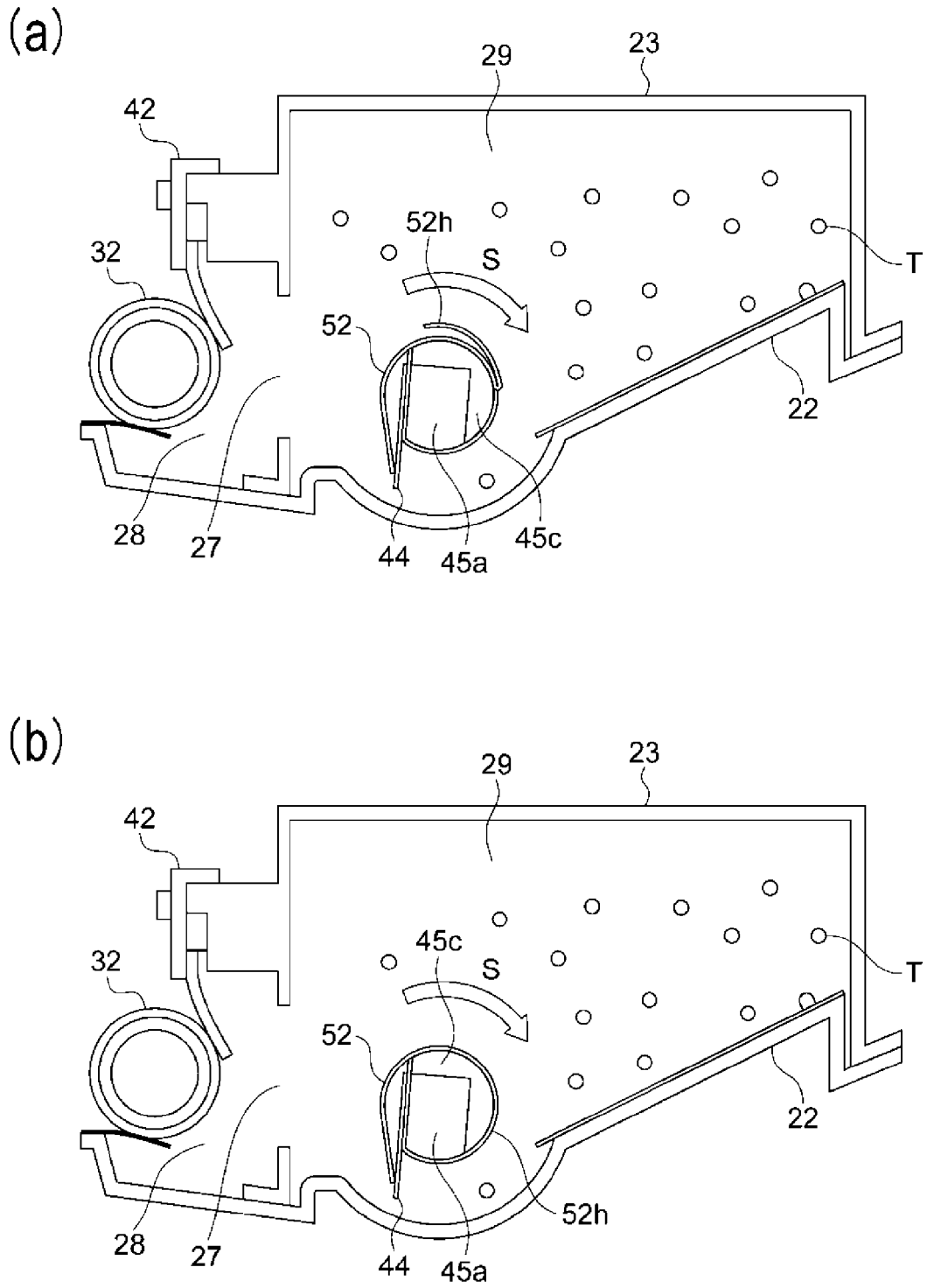

Parts (a) and (b) of FIG. 13 are sectional views each showing a state of a developing unit during image formation.

Figure 14:
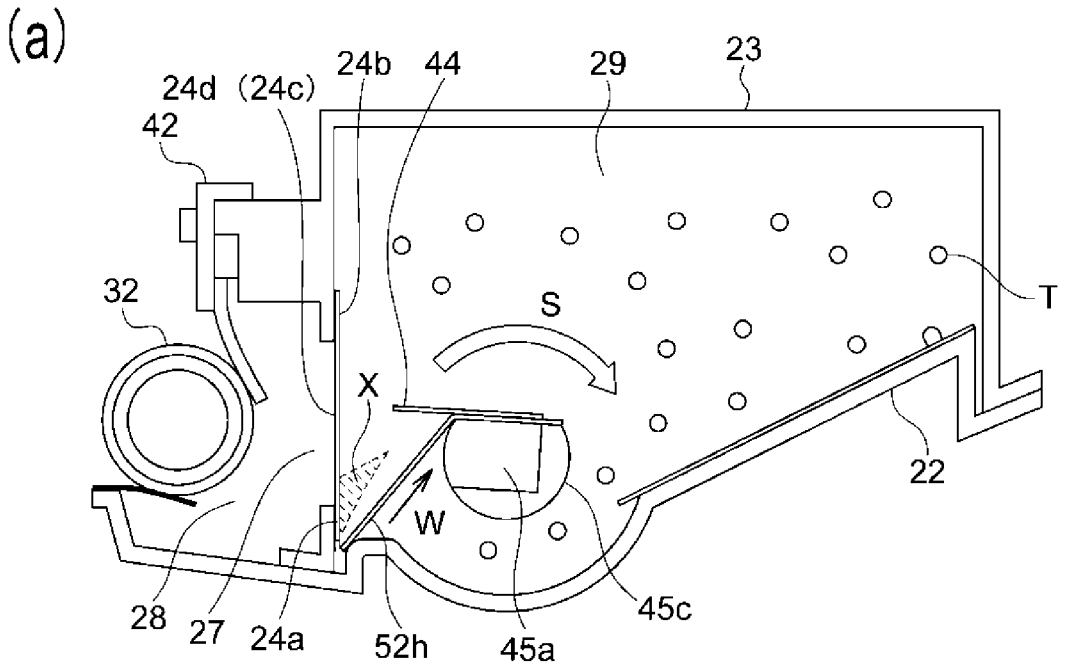
Figure 14:
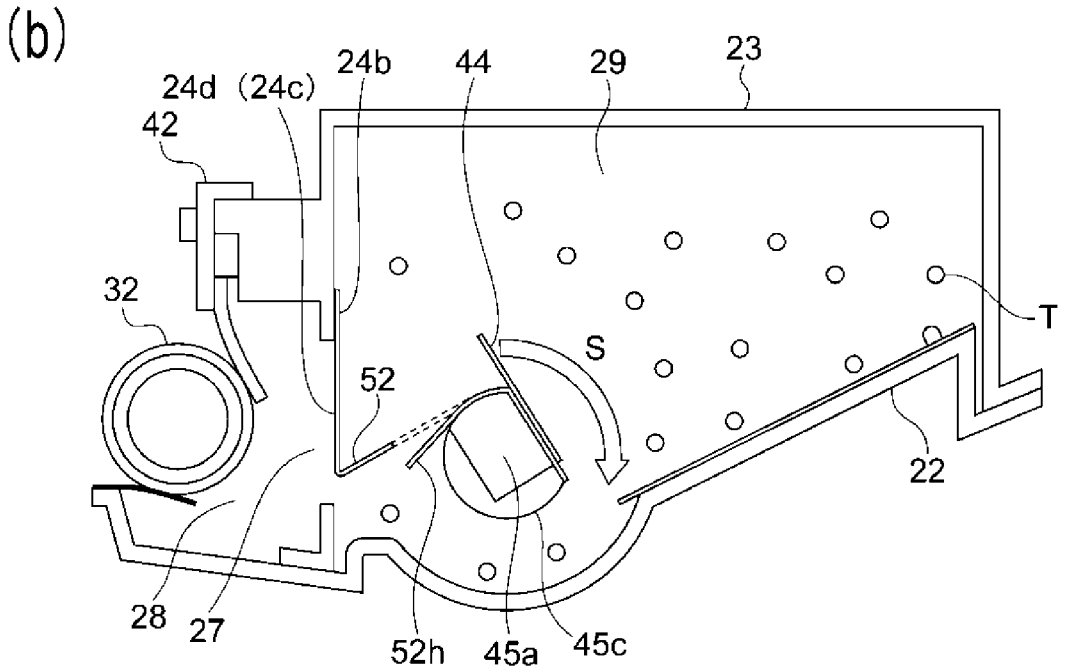

Parts (a) and (b) of FIG. 14 are sectional views each showing a state of a sealing portion during peeling in the case where the slit has a U-shape ((d) of FIG. 10).

Figure 15:
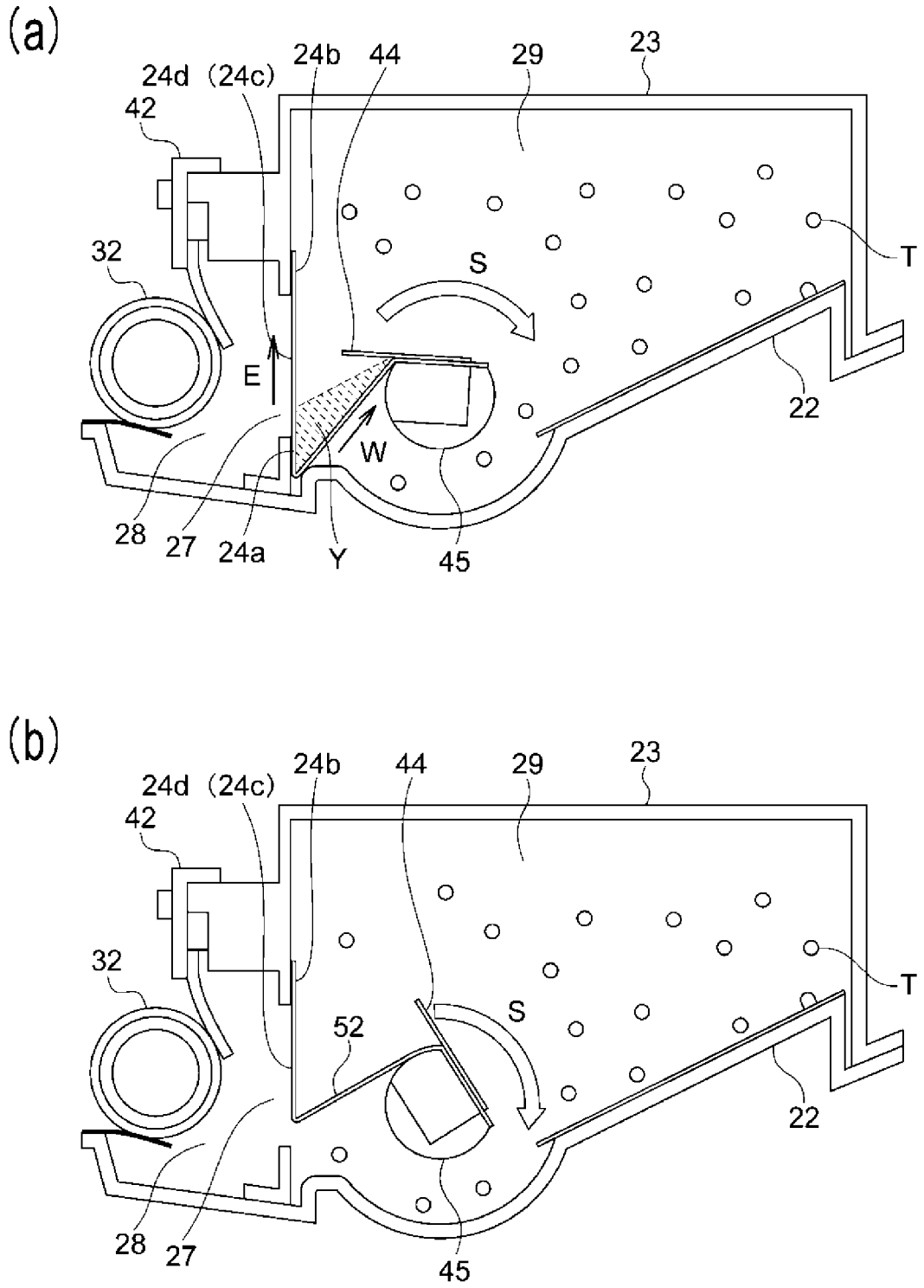

Parts (a) and (b) of FIG. 15 are sectional views showing a state of start of peeling of a first sealing portion and a state of the first sealing portion during the peeling, respectively, in Comparison Example.

Figure 16:
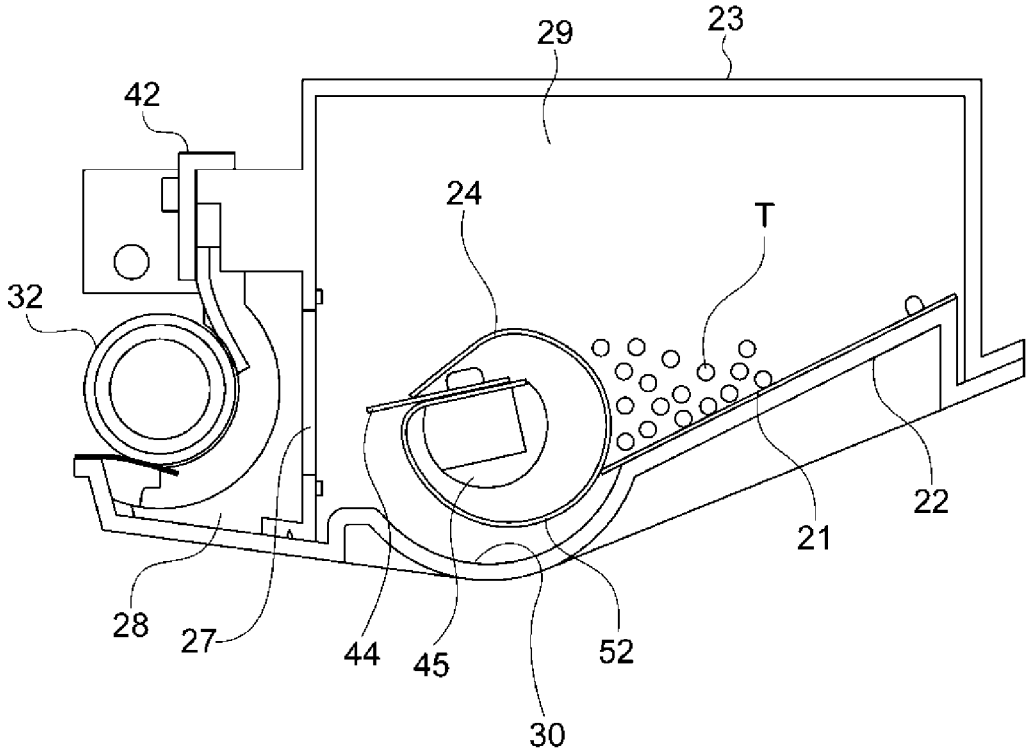

FIG. 16 is a sectional view showing a state in which a toner is stagnated at a point of contact between a seal member and a vibrating sheet in Comparison Example.

Figure 17:
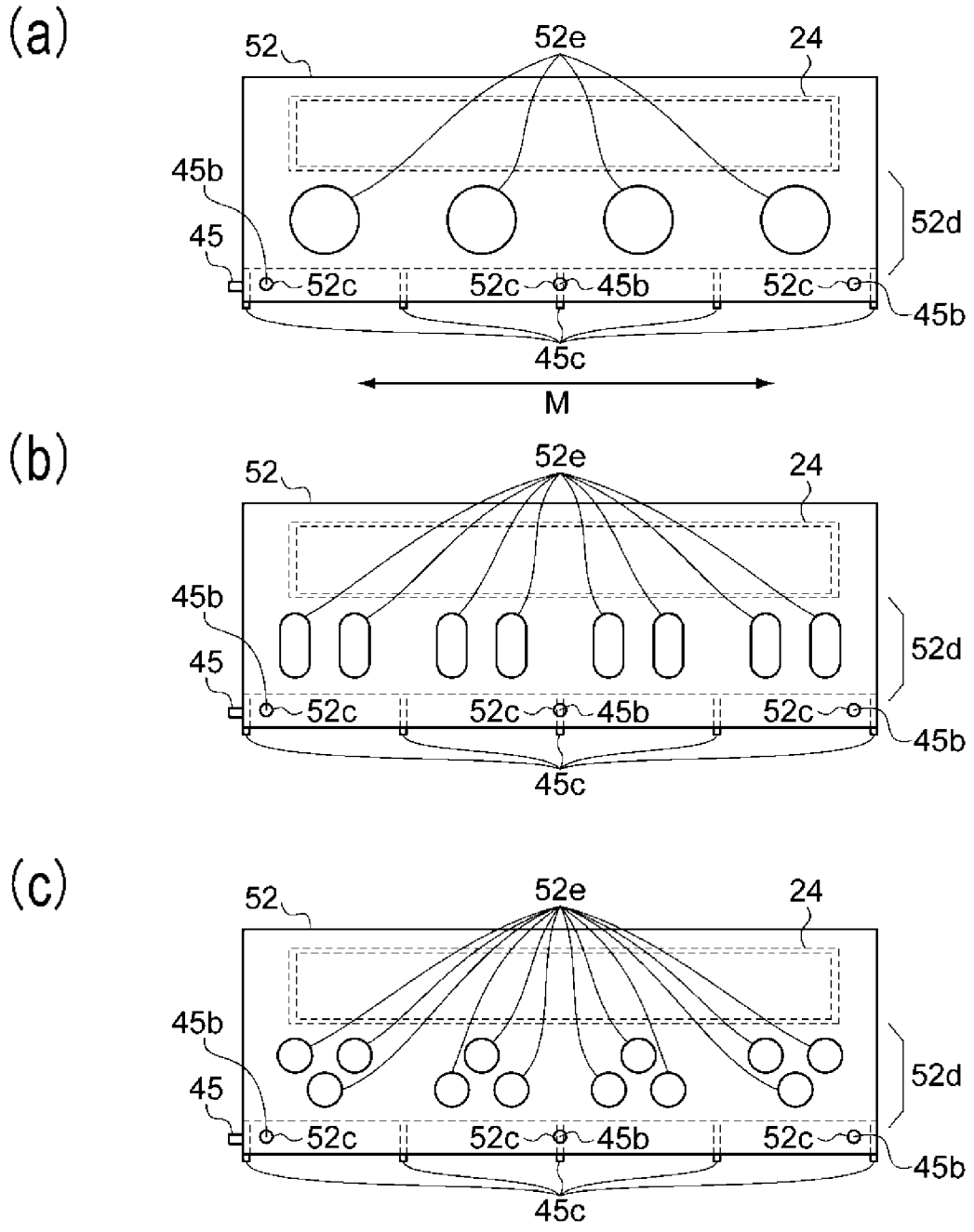

Parts (a), (b) and (c) of FIG. 17 are plan views showing modified examples of (a), (b) and (c) of FIG. 9, respectively, in which projections and fixing holes are provided to establish a non-overlapping positional relationship with respect to a direction along a shaft portion.

Figure 18:
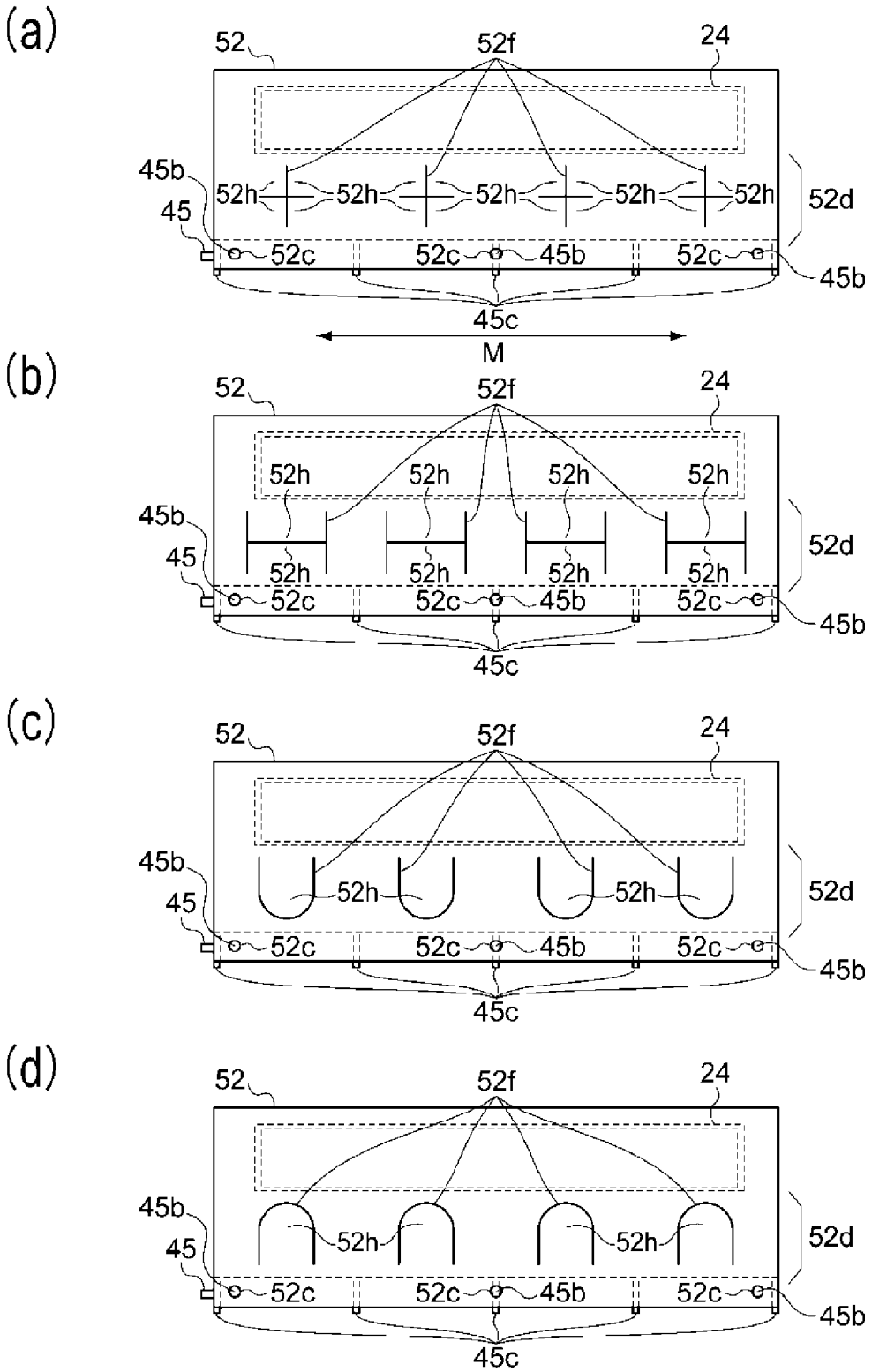

Parts (a) to (d) of FIG. 18 are plan views showing modified examples of (a) to (d) of FIG. 11, respectively, in which projections and fixing holes are provided to establish a non-overlapping positional relationship with respect to a direction along a shaft portion.

Figure 19:
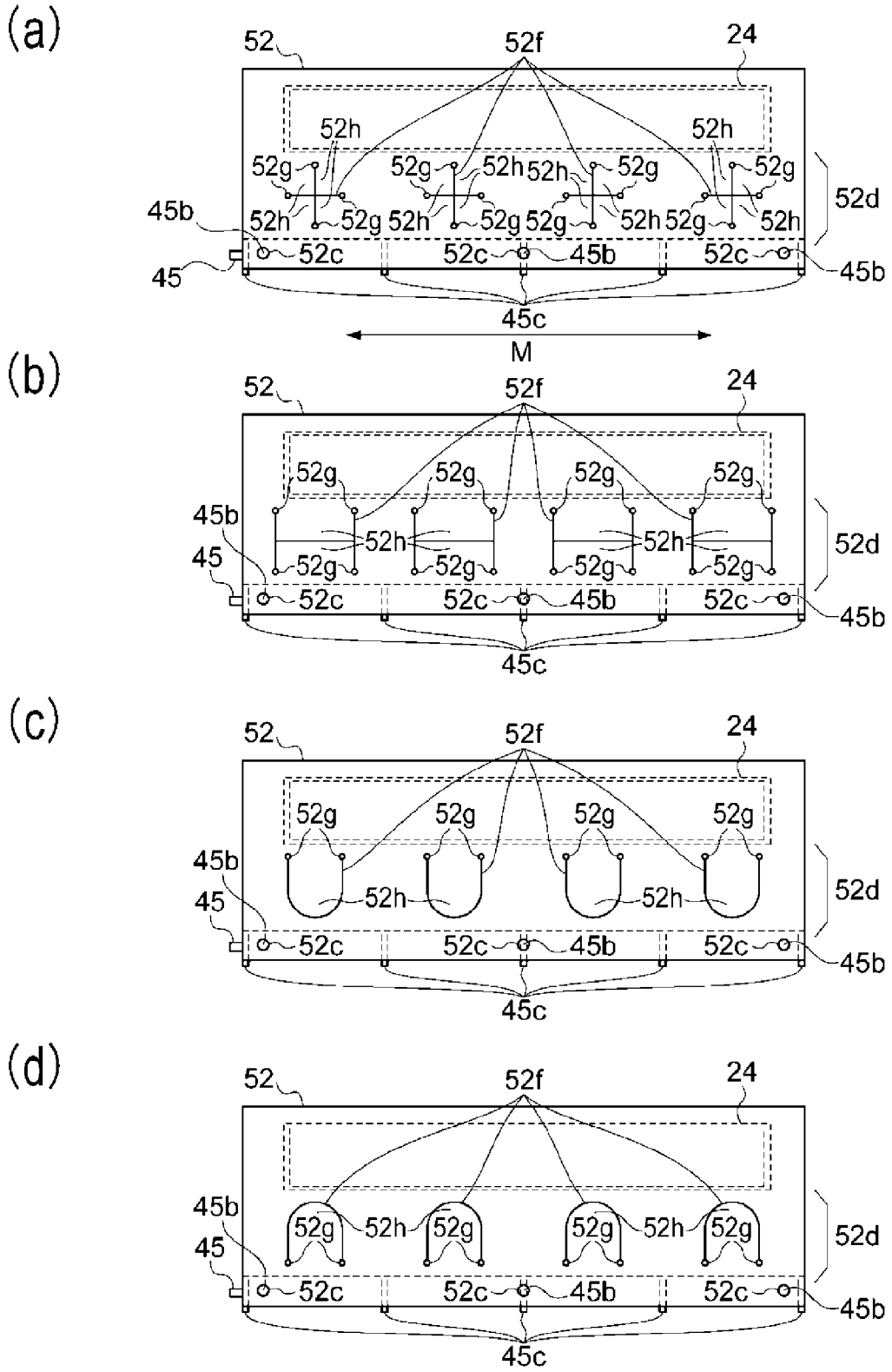

Parts (a) to (d) of FIG. 19 are plan views showing modified examples of (a) to (d) of FIG. 12, respectively, in which projections and fixing holes are provided to establish a non-overlapping positional relationship with respect to a direction along a shaft portion.

DESCRIPTION OF THE EMBODIMENTS

Hereinbelow, embodiments for carrying out the present invention will be exemplarity and specifically described with reference to the drawings. However, dimensions, materials, shapes, relative arrangements (positions) and the like of constituent elements described in the following embodiments are appropriately changed depending on constitutions or various conditions of devices (apparatuses) to which the present invention is applied. Therefore, the scope of the present invention is not limited thereto unless otherwise specified.

Embodiment 1

Figure 1:
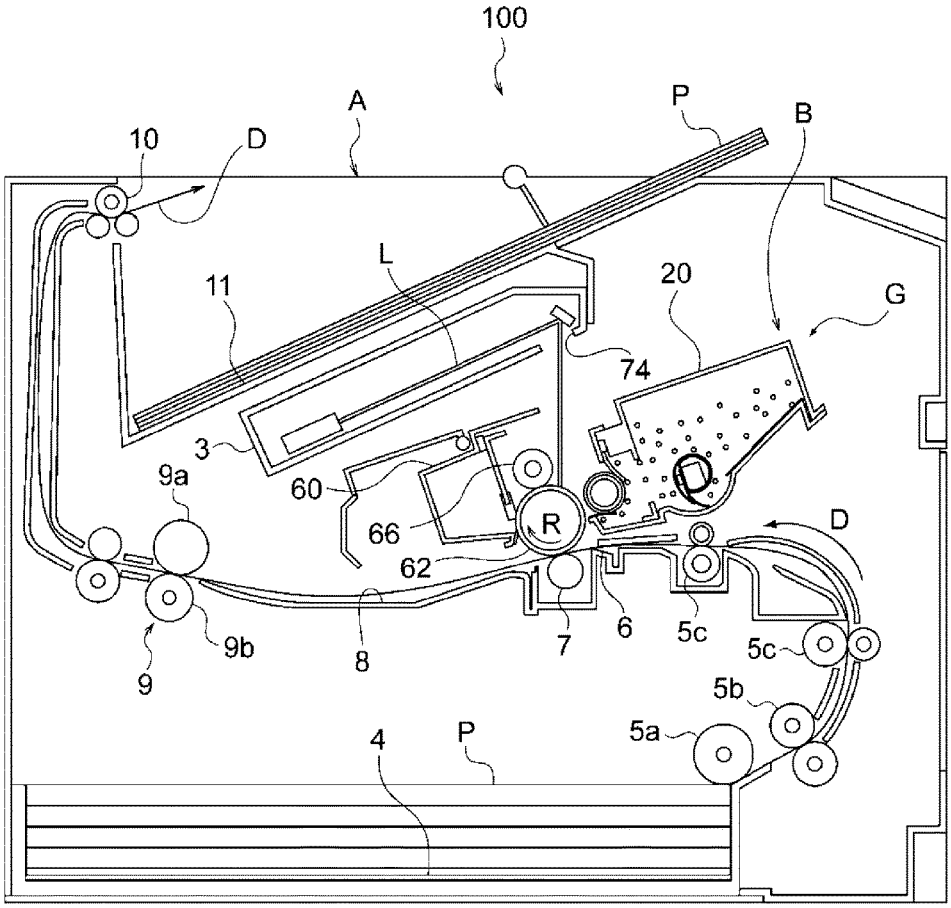
FIG. 1 is a sectional view showing a structure of an image forming apparatus according to Embodiment 1 of the present invention.

FIG. 1 is a sectional view showing a structure of an image forming apparatus 100 according to Embodiment 1 of the present invention. Incidentally, in the following description a rotational axis direction of a photosensitive drum 62 is referred to as a longitudinal direction. Further, with respect to the longitudinal direction, a side where the photosensitive drum receives a driving force from an apparatus main assembly A of the image forming apparatus 100 is referred to as a driving side (a driving force receiving portion 63*a* side shown in FIG. 4), and its opposite side is referred to as a non-driving side. Further, the apparatus main assembly (electrophotographic image forming apparatus main assembly) refers to a portion of the image forming apparatus (electrophotographic image forming apparatus) from which a cartridge B is removed.

Inside the apparatus main assembly A, the photosensitive drum 62 is disposed. At a periphery of the photosensitive drum 62, a charging roller 66, an exposure device 3 (laser scanner unit), a developing unit 20 (developing device), a transfer roller 7, a cleaning unit 60 and the like are provided. Inside the apparatus main assembly A, a tray 4 for accommodating sheets P (recording material) is provided below the cartridge B. Further, inside the apparatus main assembly A, along a feeding direction D of the sheet P, a pick-up roller 5*a*, a feeding roller pair 5*b*, a conveying roller pair 5*c*, a transfer guide 6, the transfer roller 7, a conveying guide 8, a fixing device 9, a discharging roller pair 10, a discharge tray 11 and the like are successively provided. Incidentally, the fixing device 9 includes a heating roller 9*a* and a pressing roller 9*b*.

An operation of such an image forming apparatus 100 will be described. A surface of the photosensitive drum 62 is electrically charged uniformly by the charging roller 66, and an electrostatic image is formed by the exposure device 3, and then a developer image is formed with a developer by the developing unit 20. On the other hand, the sheet P accommodated in the tray 4 passes through the pick-up roller 5*a*, the feeding roller pair 5*b*, the conveying roller pair 5*c* the transfer guide 6, a nip between the photosensitive drum 62 and the transfer roller 7, the conveying guide 8, the fixing device 9, and the discharging roller pair 10, thus being discharged onto the discharge tray 11. Incidentally, from the exposure device 3, laser light L is emitted through an exposure window portion 74. An image forming portion G for forming the image includes at least the photosensitive drum 62 and may also include the charging roller 66, the exposure device 3, the developing unit 20, the cleaning unit 60, the transfer roller 7, the fixing device 9 and the like.

Figure 2:
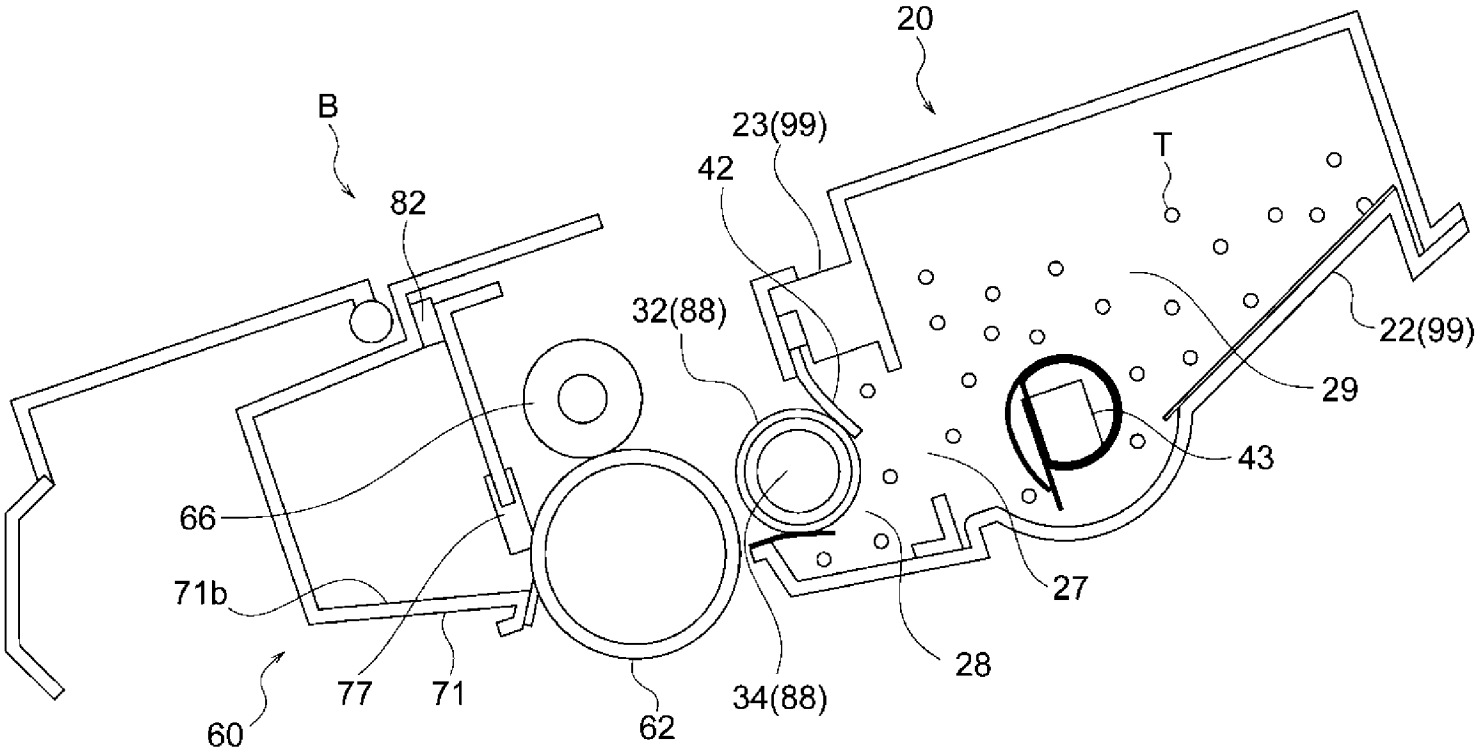
FIG. 2 is a sectional view showing a structure of a cartridge.

FIG. 2 is a sectional view showing a structure of the cartridge B. As shown in FIG. 2, the cartridge B as a process cartridge detachably mountable to the apparatus main assembly A includes the cleaning unit 60 and the developing unit 20. The cleaning unit 60 supports the photosensitive drum 62 and the charging roller 66. The cleaning unit 60 includes a cleaning frame 71. Inside the cleaning frame 71, a residual toner chamber 71*b* for accommodating a residual toner is provided and partitioned. A blade 77 (cleaning blade) is mounted to the cleaning frame 71 and is contacted to the photosensitive drum 62.

The developing unit 20 includes a developing container 99 as an accommodating container for accommodating the developer. The developing container 99 includes a developing container body 23, a bottom member 22, a rotatable member 45 described later, and a seal member 52. The developing container body 23 supports a developing sleeve 32. The developing container 99 includes a developing chamber 28 as an accommodating chamber including a developing roller 88 as a developer carrying member for feeding a toner T to the surface of the photosensitive drum 62 as an electrophotographic photosensitive drum. Further, the developing container 99 includes a feeding chamber 29 as an accommodating chamber for accommodating the toner T and for feeding the toner T to the developing roller 88. Further, the feeding chamber 29 and the developing chamber 28 communicate with each other through an opening 27. The contents of the seal member 52 for sealing the opening 27 will be described later.

The developing roller 88 includes the developing sleeve 32 and a magnet roller 34 provided inside the developing sleeve 32. Inside the feeding chamber 29, a feeding member 43 is provided. Further, a developing blade 42 is mounted to the developing chamber 28. The developing blade 42 regulates a layer thickness of the developer on the surface of the developing sleeve 32. Inside the feeding chamber 29 and the developing chamber 28, the toner T is contained.

An operation of the developing unit 20 will be described below.

The toner T in the feeding chamber 29 is stirred and fed by rotation of a feeding member 43, so that the toner T is sent to the developing chamber 28. The toner T is carried by a magnetic force of the magnet roller 34 on the surface of the developing sleeve 32. The toner T is regulated in layer thickness by the developing blade 42 while being triboelectrically charged. The toner T is transferred onto the electrostatic image on the photosensitive drum 62, so that the electrostatic latent image is visualized as a toner image on the surface of the photosensitive drum 62.

The toner transferred on the surface of the photosensitive drum 62 is transferred onto the sheet P by the transfer roller 7. However, a residual toner remaining on the surface of the photosensitive drum 62 is removed by the blade 77 and is stored in the residual toner chamber 71*b*. The thus-cleaned photosensitive drum 62 is used again in the image forming process. Incidentally, the charging roller 66, the developing sleeve 32 and the blade 77 which are described above correspond to process means actable on the photosensitive drum 62. Further, the residual toner chamber 71*b* and the blade 77 are sealed with the seal member 82.

Figure 3:
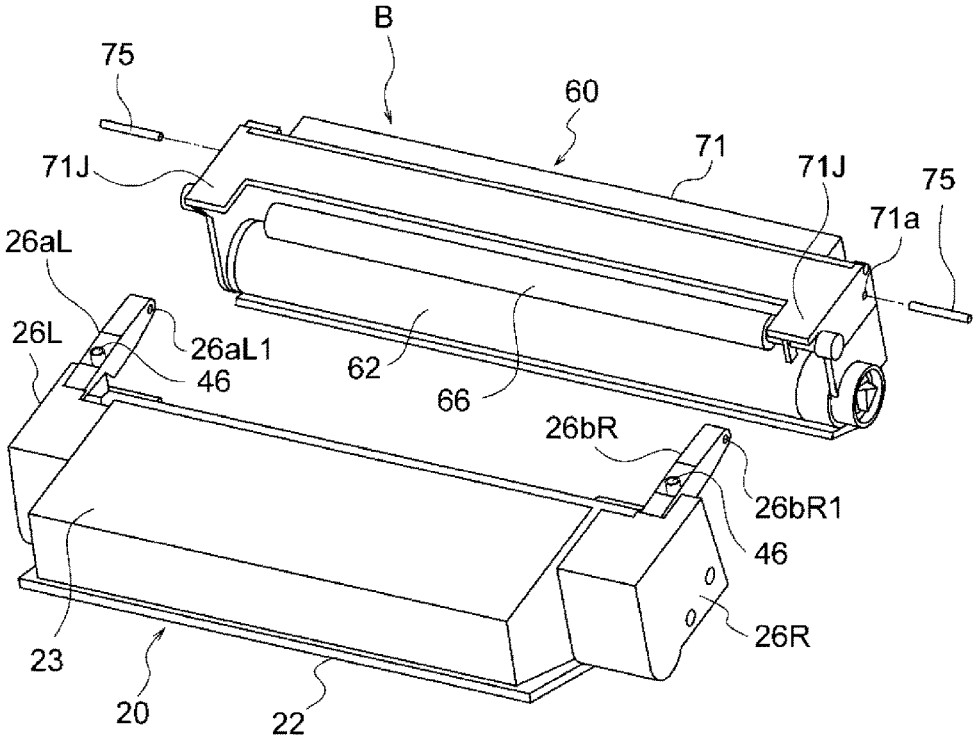
FIG. 3 is an exploded perspective view of the cartridge.

FIG. 3 is an exploded perspective view of the cartridge B. As shown in FIG. 3, the cartridge B is constituted by combining the cleaning unit 60 and the developing unit 20. The cleaning unit 60 is constituted by a cleaning frame 71, the photosensitive drum 62, the charging roller 66, and the blade 77 (FIG. 2). On the other hand, the developing unit 20 is constituted by the developing container body 23, the bottom member 22, first and second side members 26L and 26R, the developing blade 42 (FIG. 2), the developing sleeve 32 (FIG. 2), the magnet roller 34 (FIG. 2), the feeding member 43 (FIG. 2), and an urging member 46.

The cleaning frame 71 is provided with engaging holes 71*a*. The developing container body 23 is provided with arm portions 26*a*L and 26*b*R.

The arm portion 26*a*L is provided with a rotational movement hole 26*a*L1, and the arm portion 26*b*R is provided with a rotational movement hole 26*b*R1. Further, the cleaning frame 71 and the developing container body 23 are connected by inserting connecting member 75 into the engaging holes 71*a* through the rotational movement holes 26*a*L1 and 26*b*R1. As a result, the cleaning unit 60 and the developing unit 20 are connected with each other rotatably about the connecting members 75.

Urging members 46 are mounted at base portions of the arm portions 26*a*L and 26*b*R. When the urging members 46 abut against back surfaces of projected portions 71J of the cleaning frame 71, the developing unit 20 is urged toward the cleaning unit 60 with the connecting members 75 as the rotation centers. As a result, the developing sleeve 32 (FIG. 2) is pressed toward the photosensitive drum 62 (FIG. 2) with reliability. Further, by a gap (spacing) holding member 38 (FIG. 5) mounted at each of the end portions of the developing sleeve 32, the developing sleeve 32 is held in a position with a predetermined gap from the photosensitive drum 62.

Figure 4:
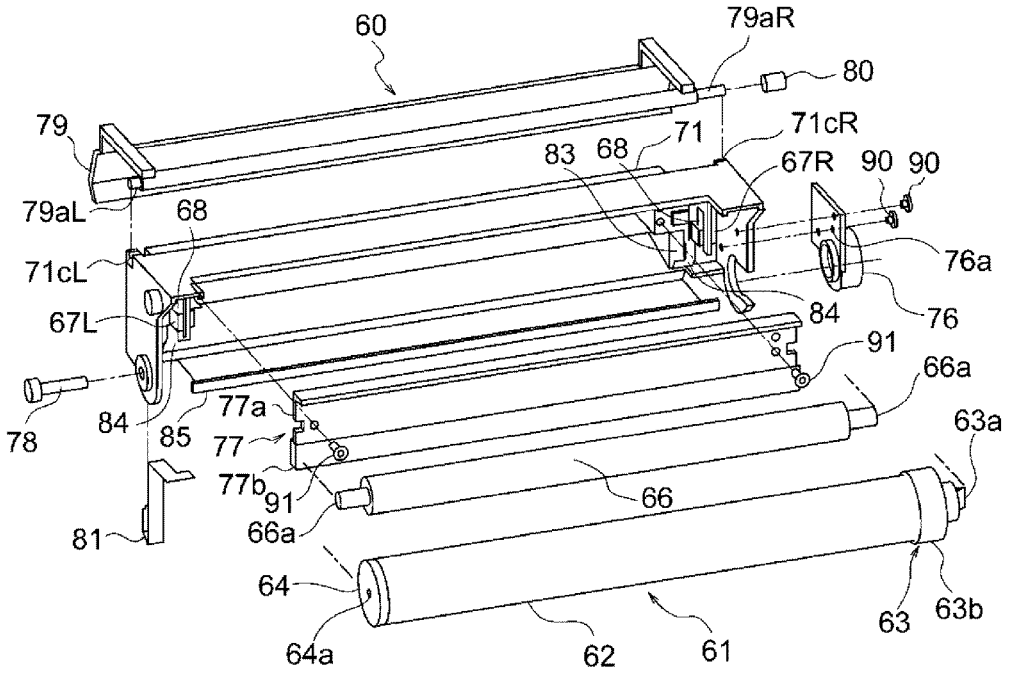
FIG. 4 is an exploded perspective view of a cleaning unit.

FIG. 4 is an exploded perspective view of the cleaning unit 60. As shown in FIG. 4, the cleaning unit 60 includes the blade 77. The blade 77 is constituted by a supporting member 77*a* formed with a metal plate and an elastic member 77*b* formed of an elastic material such as urethane rubber. The blade 77 is fixed on the cleaning frame 71 by screws 91 in a predetermined position. An end of the elastic member 77*b* is set in a position such that the elastic member 77*b* can contact the photosensitive drum 62. When the elastic member 77*b* contacts the surface of the photosensitive drum 62, the residual toner is removed from the outer peripheral surface of the photosensitive drum 62.

The photosensitive drum 62 is a part of a drum unit 61. At an end portion of the photosensitive drum 62, a flange 64 is mounted and is provided with a hole 64*a*. At another end portion of the photosensitive drum 62, a flange portion 63 is mounted and includes a flange gear portion 63*b* provided with a gear and includes a driving force receiving portion 63*a* to be mounted to a shaft. Incidentally, the charging roller 66 is rotated about a shaft portion 66*a*. The driving force receiving portion 63*a* receives a driving force from the apparatus main assembly A. The flange gear portion 63*b* transmits the driving force to the developing sleeve 32.

Further, to the cleaning frame 71, an electrode plate 81, an urging member 68 and charging roller bearings 67L and 67R are mounted.

The shaft portion 66*a* of the charging roller 66 is engaged into the charging roller bearings 67L and 67R. The shaft portion 66*a* is engaged into a hole 76*a* of a bearing member 76. The charging roller 66 is urged toward the photosensitive drum 62 by the urging member 68, and is rotatably supported by the charging roller bearings 67L and 67R. Then, the charging roller 66 is rotated by rotation of the photosensitive drum 62.

The photosensitive drum 62 is connected integrally with flange 64 and the flange portion 63 and thus constitutes drum unit 61. This connecting method uses caulking, bonding, welding or the like. To the flange 64, an unshown grounding contact and the like are connected.

When the charging roller 66 and the photosensitive drum 62 are mounted to the cleaning frame 71, the bearing member 76 is integrally fixed with screws 90 on the cleaning frame 71 in the driving side, and the drum shaft 78 is press-fitted and fixed in the cleaning frame 71 in the non-driving side. Further, the bearing member 76 is engaged with the flange portion 63, and a drum shaft 78 is engaged with a hole 64*a* of the flange 64. As a result, the drum unit 61 is rotatably supported by the cleaning frame 71.

Figure 5:
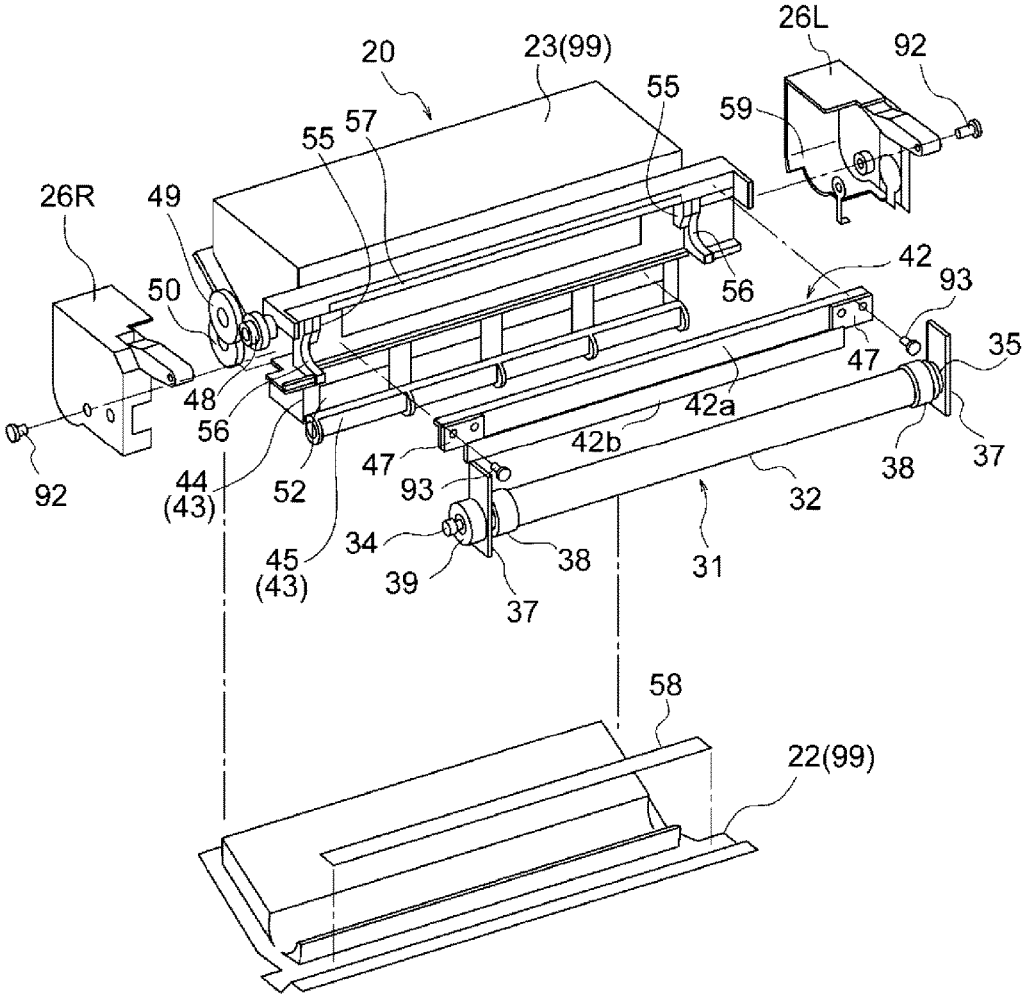
FIG. 5 is an exploded perspective view of a developing unit.

FIG. 5 is an exploded perspective view of the developing unit 20. As shown in FIG. 5, the developing container 99 of the developing unit 20 includes the developing container body 23 and the bottom member 22. When the developing container body 23 and the bottom member 22 are combined, the developing chamber 28 (FIG. 2) and the feeding chamber 29 (FIG. 2) are formed. The developing container body 23 and the bottom member 22 are integrally connected with each other by welding or the like. The feeding member 43 includes a rotatable member 45 and a feeding sheet 44 mounted to the rotatable member 45.

The feeding member 43 is supported by the developing container body 23 in the non-driving side, and is supported by a feeding gear 50 mounted to the developing container body 23 in the driving side. As a result, the feeding member 43 is rotated in the feeding chamber 29 by the rotation of the feeding gear 50. The developing blade 42 includes the supporting member 42*a* and the elastic member 42*b* which are described above, and is fixed together with a cleaning member 47 in a predetermined position relative to the developing container body 23 by screws 93 at end portions of the supporting member 42*a*.

A developing roller unit 31 is constituted by the developing sleeve 32, the magnet roller 34, a flange 35, the gap holding member 38, a bearing member 37, a developing roller gear 39 and the like.

From an end portion of the developing sleeve 32 in the non-driving side, the magnet roller 34 is inserted, and at the end portion, the flange 35 is press-fitted and fixed. The gap holding member 38 is mounted at each of the end portions of the developing sleeve 32. Further, outside the gap holding member 38, the bearing member 37 is disposed, and in the driving side, the developing roller gear 39 is assembled outside the bearing member 37. By the bearing member 37 disposed at each of the end portions of the developing sleeve 32, the developing sleeve 32 is rotatably supported.

First and second gears 48 and 49 as a drive transmission member are rotatably engaged with the developing frame 1. As a result, the driving force received from the apparatus main assembly A is transmitted to the developing sleeve 32 and the feeding member 43 by successive engagement and rotation of the flange gear portion 63*b* (FIG. 4), the developing roller gear 39, the first and second gears 48 and 49, and the feeding gear 50.

The first and second side members 26L and 26R are fixed with screws 92 at end portions, respectively, of the developing container body 23 with respect to the longitudinal direction of the developing frame. At that time, the bearing members 37 of the developing roller unit 31 are held by the first and second side members 26L and 26R.

Part (a) of FIG. 6 is an exploded perspective view showing a state in which the feeding member 43, the developing container body 23, the seal member 52 and the feeding sheet 44 are disassembled. As shown in (a) of FIG. 6, the developing container body 23 is provided with the opening 27 for establishing communication between the feeding chamber 29 and the developing chamber 28. The developing container 99 includes the seal member 52 for unsealably sealing the opening 27 and the rotatable member 45 rotatably supported inside the feeding chamber 29.

The seal member 52 includes a sealing portion 52J1 for sealing the opening 27, a connecting portion 52J2 connected with the rotatable member 45, and an interconnecting portion 52J3 between the sealing portion 52J1 and the connecting portion 52J2, and further includes at least one hole 52*c* at the interconnecting portion 52J3. The seal member 52 is constituted by a material compatible with a material for the developing container body 23 or a material including an adhesive layer. The feeding sheet 44 is formed of a flexible material such as polyethylene terephthalate (PET), polycarbonate (PC) or polyphenylene sulfide (PPS).

The connecting portion 52J of the seal member 52 in a first end portion 52*a* side, a plurality of fixing holes 52*c* are formed. In a first end portion 44*a* side of the feeding sheet 44, a plurality of fixing holes 44*b* are formed. At a shaft portion 45*a* of the rotatable member 45, a plurality of projections 45*b* are formed. Further, the rotatable member 45 includes the shaft portion 45*a* and at least one projection 45*c* extending in a direction in which the projection 45*c* is spaced from the shaft portion 45*a*.

The projection 45*c* is, as shown in (b) of FIG. 6, bonded to the rotatable member 45 and is provided to ensure a peripheral length in which the seal member 52 is wound about the rotatable member 45 when the rotatable member 45 is rotated. That is, in the case of the rotatable member 45 provided with no projection 45*c*, a length in which the rotatable member 45 can wind up the seal member 52 is short, but in the case of the rotatable member 45 provided with the projection 45*c*, the length in which the rotatable member 45 can wind up the seal member 52 becomes long.

Part (a) of FIG. 6 is a perspective view showing a state in which the seal member 52 is bonded to the feeding member 43 and the developing container body 23. As shown in (b) of FIG. 6, the seal member 52 is bonded to the feeding member 43 and the developing container body 23. The plurality of fixing holes 52*c* of the seal member 52 and the plurality of fixing holes 44*b* of the feeding sheet 44 are successively engaged in this order with the projections 45*b* of the rotatable member 45. Thereafter, by caulking the projections 45*b* of the rotatable member 45, the seal member 52, the feeding sheet 44 and the rotatable member 45 are integrally provided.

Here, a method of integrating the seal member 52, the feeding sheet 44 and the rotatable member 45 may also be another method using welding, snap-fitting, double-side tape or the like, and is not necessarily limited. Incidentally, in this embodiment, the feeding sheet 44 is provided, but may also be provided as a part of the rotatable member 45 or may also be not provided.

The seal member 52 is required to have a length in which the seal member 52 can cover the opening 27 and is mountable to the rotatable member 45. Here, in order to prevent the end portion of the seal member 52 from contacting the end of the feeding sheet 44 after the seal member 52 is unsealed, the feeding sheet 44 and the seal member 52 have the same mounting phase. Here, the feeding sheet 44 and the seal member 52 are caulked together, but may also be mounted to the rotatable member 45 is different positions.

A second end portion 52*b* of the seal member 52 is peelably fixed on the developing container body 23 along an edge of the opening 27 by the thermal welding or the like. This fixed portion is the sealing portion 24. Here, a method of forming the sealing portion 24 of the seal member 52 on the developing container body 23 may also be a method other than the thermal welding, and may, e.g., be bonding, laser welding and the like.

The sealing portion 24 is constituted by a first sealing portion 24*a* and a second sealing portion 24*b* which are provided along a longitudinal direction of the opening 27 and by a third sealing portion 24*c* and a fourth sealing portion 24*d* which are provided along a widthwise direction of the toner supply opening 27. Further, the first to fourth sealing portions 24*a*, 24*b*, 24*c* and 24*d* are continuously formed, so that it becomes possible to seal (confine) the toner.

The first sealing portion 24*a* is located in the first end portion 52*a* side of the toner seal member 52 as seen from the opening 27.

The second portion 24*b* is located in an opposite side, i.e., a second end portion 52*b* side.

The third sealing portion 24*c* is located in the non-driving side, and the fourth sealing portion 24*d* is located in the driving side.

The connecting portion 52*d* between the fixing holes 52*c* of the seal member 52 and the sealing portion 24 is provided with a plurality of holes 52*e* with respect to the longitudinal direction. Further, during unsealing of the seal member 52 described later, in order to effectively obtain a tension between the sealing portion 24 and the rotatable member 45, the shaft portion 45*a* of the rotatable member 45 is provided with a plurality of projections 45*c* in a non-overlapping position with the holes 52*e* with respect to the longitudinal direction. The projections 45*c* have an outer configuration larger than the shaft portion 45*a* as seen from the longitudinal direction, and during the unsealing of the seal member 52, the seal member 52 is wound about the rotatable member 45 along the projections 45*c*.

Parts (a) to (d) of FIG. 7 are sectional views showing a process in which the seal member 52 is gradually unsealed to expose the opening 27. As shown in (a) of FIG. 7, the seal member 52 is loosen between the first sealing portion 24*a* thereof and the fixing holes 52*c* as an engaging portion. As a result, even when a force acts on the rotatable member 45 during assembling and transportation of the process cartridge B, the toner seal member 52 is partly loosened and therefore tension is not applied to the seal member 52. Thus, a sealing force is maintained.

When the cartridge B is mounted in the apparatus main assembly and receives the driving force from the apparatus main assembly A, the rotatable member 45 is rotated in an arrow S direction. When the rotatable member 45 is rotated, the seal member 52 is wound up around the outer peripheral surface of the rotatable member 45, and tension is applied to the seal member 52 ((a) and (b) of FIG. 7).

When the rotatable member 45 is further rotated, the seal member 52 is peeled off in the order of the first sealing portion 24*a*, the third and four sealing portions 24*c* and 24*d*, and the second sealing portion 24*b*. As a result, the opening 27 is unsealed (exposed), so that the toner is fed from the feeding chamber 29 to the developing chamber 28 by the feeding member 43 (FIG. 2).

Part (a) of FIG. 8 is a sectional view showing a state of the first sealing portion 24*a* at the time of start of the peeling of the first sealing portion 24*a*, and (b) of FIG. 8 is a sectional view showing a state of the third and fourth sealing portions 24*c* and 25*d* during the peeling of the sealing portions 24*c* and 24*d*. As shown in (a) of FIG. 8, a toner range in which the toner is pushed away by the seal member 52 in a period from start of the unsealing of the first sealing portion 24*a* to the state of (b) of FIG. 8 by rotation of the rotatable member 45 is X.

By the presence of the holes 52*e* in the connecting portion 52*d* of the seal member 52, the toner is capable of passing through the holes 52*e*, and therefore compared with the case where there are no holes 52*e* (in a seal member 52 shown in FIG. 15 in Comparison Example), the toner range in which the toner is pushed away becomes small (X<Y). For that reason, compared with the case where there are no holes 52*e*, a force for pushing away the toner becomes small. As a result, a force W required during the unsealing of the sealing portion 24 can be reduced, and therefore a torque for rotating the rotatable member 45 during the unsealing of the sealing portion 24 can be made small.

Parts (a) to (c) of FIG. 9 are plan views each showing a state of the holes 52*e*. A shape, the number and arrangement of the holes 52*e* are not limited to those described above. The holes 52*e* may also have a circular shape as shown in (a) of FIG. 9 or an elongated circular shape extending in a direction perpendicular to the arrow M direction as shown in (b) of FIG. 9, or may also be arranged so as to be shifted with respect to a direction perpendicular to the longitudinal direction as shown in (c) of FIG. 9. Further, the holes 52*e* and the projections 45*c* are disposed to establish a non-overlapping positional relationship with respect to the arrow M direction along the shaft portion 45*a* (i.e., a direction in which the shaft portion 45*a* extends). That is, the holes 52*e* and the projections 45*c* are disposed so that there are no holes 52*e* with respect to the direction perpendicular to the arrow M direction as seen from the projections 45*c*.

The reason why the projections 45*c* are arranged in such a manner will be described. That is because the projections 45*c* have the function of winding up the seal member 52 but a winding force thereof is stronger when the holes 52*e* are not formed with respect to the direction perpendicular to a direction along the shaft of the rotatable member 45. Further, assuming the case where the holes 52*e* are formed with respect to the direction perpendicular to the direction along the shaft of the rotatable member 45, in this case, the projections 45*c* pull the holes 52*e* when the rotatable member 45 is rotated, so that the holes 52*e* can lose the shape thereof.

Here, as a modified example of the constitutions of FIG. 9, constitutions of FIG. 17 may also be employed. In the case of the constitutions of FIG. 17, the projections 45*b* and the projections 45*c* of the rotatable member 45 are disposed to establish a non-overlapping positional relationship with respect to the arrow M direction along the shaft portion 45*a* (i.e., a direction in which the shaft portion 45*a* extends) (FIG. 6). That is, the projections 45*b* and the projections 45*c* of the rotatable member 45 are disposed so that there are no holes 52*e* with respect to the direction perpendicular to the arrow M direction as seen from the projections 45*c* and the projections 45*b* of the rotatable member 45.

The reason why the projections 45*c* and the projections 45*b* of the rotatable member 45 are arranged in such a manner will be described. That is because the projections 45*c* have the function of winding up the seal member 52 and the projections 45*b* are provided for fixing the seal member 52 as described above but a winding force thereof is stronger when the holes 52*e* are not formed with respect to the direction perpendicular to a direction along the shaft of the rotatable member 45. Further, assuming the case where the holes 52*e* are formed with respect to the direction perpendicular to the direction along the shaft of the rotatable member 45, when the rotatable member 45 winds up the seal member 52 or is rotated after winding up the seal member 52, the projections 45*c* pull the holes 52*e* or bite into the holes 52*e*, so that the holes 52*e* can lose the shape thereof or can cause cracks to break the seal member 52.

The plurality of holes 52*e* are provided and arranged in the arrow M direction along the shaft portion 45*a* (in the direction in which the shaft portion 45*a* extends). Incidentally, the holes 52*e* may only be required to permit passing of the developer and therefore may also be dot-like holes consisting of a gathering of many small holes although the holes are not illustrated.

Embodiment 2

In this embodiment, a portion different from Embodiment 1 will be specifically described. Materials, shapes and the like of constituent elements (portions) are the same as those in Embodiment 1 unless otherwise specified. The constituent elements are represented by adding the same reference numerals or symbols, and will be omitted from detailed description.

FIG. 2 also shows a structure of the cartridge B in Embodiment 2. In Embodiment 2, by providing the holes 52*e* in the connecting portion 52*d* of the seal member 52, in a cartridge in which a vibrating sheet 21 is provided on the bottom member 22 of the developing container 99, it is possible to decrease a remaining toner amount during an occurrence of white (print) dropout of an image.

The cartridge B includes the cleaning unit 60 and the developing unit 20. The developing unit 20 includes the developing container 99 as the accommodating container for accommodating the developer. The developing container 99 includes the developing container body 23, the bottom member 22, the rotatable member 45 and the seal member 52.

The vibrating sheet 21 is supported on the bottom member 22, and the feeding sheet 44 is periodically contacted to a side end portion of the vibrating sheet 21 in the feeding chamber 29 and thus is vibrated, so that the toner T on the vibrating sheet 21 is moved into a rotation region of the feeding sheet 44.

The vibrating sheet 21 is fixed to the bottom member 22 at a rear end portion of the bottom member 22, i.e., in the neighborhood of an end portion remote from the developing chamber 28 by being secured with screws 94 in longitudinal several positions.

FIG. 10 is a sectional view showing a state of the developing unit during image formation. As shown in FIG. 10, the feeding chamber 29 includes the bottom member 22 having an inclined surface descending toward the opening 27, a recessed portion 30 recessed in a position where the recessed portion 30 is closer to the opening 27 than the bottom member 22, and the vibrating sheet 21 disposed on the surface of the bottom member 22, to which vibration is applied by contact with the seal member. An end portion of the vibrating sheet 21 in the opening side in projected from the bottom member 22 toward the opening 27.

After the sealing portion 24 is unsealed, the seal member 52 is moved together with the rotatable member 45 through a lifetime of the cartridge. Particularly, immediately after the unsealing of the sealing portion 24, in the case where the toner T in a sufficient amount is present in the developing container 99, the seal member 52 is placed in a wound state about (the shape of) the rotatable member 45. As a result, the seal member 52 causes creep deformation and thus is deformed in a cylindrical shape.

FIG. 16 is a sectional view showing a developing container having a structure in which a seal member 52 is not provided with holes 52*c* in Comparison Example. As shown in FIG. 16, when a remaining toner amount becomes small, the seal member 52 is moved (rotated) together with the rotatable member 45 while being in a state in which a part of the seal member 52 contacts the vibrating sheet 21, and therefore the toner T on the vibrating sheet 21 is stagnated at a contact portion between the seal member 52 and the vibrating sheet 21. The stagnate toner T cannot be moved into a rotation region of a stirring member, so that the toner cannot be used up.

In this embodiment, by the presence of the holes 52*e* in the connecting portion 52*d* of the seal member 52, the toner T on the vibrating sheet 21 can pass through the holes 52*e* and thus can be moved into the rotation region of the feeding sheet 44. For that reason, during the occurrence of the white dropout of the image, the toner T can be used up without remaining at a portion where the seal member 52 contacts the vibrating sheet 21. Incidentally, the toner T is entangled in the seal member 52 in some cases. When there are the holes 52*e*, also such a toner T can be discharged.

Embodiment 3

In this embodiment, a portion different from Embodiments 1 and 2 will be specifically described. Materials, shapes and the like of constituent elements (portions) are the same as those in Embodiments 1 and 2 unless otherwise specified. The constituent elements are represented by adding the same reference numerals or symbols, and will be omitted from detailed description.

Parts (a) to (d) of FIG. 11 are plan views each showing the seal member 52 in Embodiment 3. In Embodiments 1 and 2, the seal member 52 is provided with the holes 52*e*, but in Embodiment 3, as shown in FIG. 11, the interconnecting portion 52J3 of the seal member 52 is provided with at least one slit 52*f*. Here, a portion constituted by the slit 52*f* is referred to as a tongue piece 52*h*.

The shape of the slit 52*f* is, e.g., a cross-shape ((a) of FIG. 11), an H-shape ((b) of FIG. 11), a U-shape ((c) of FIG. 11) and a reversed, U-shape ((d) of FIG. 11), and the like. As described above, the plurality of slits 52*f* and the plurality of projections 45*c* are disposed to establish the non-overlapping position relationship with respect to the arrow M direction along the shaft portion 45*a* (with respect to the direction in which the shaft portion 45*a* extends). The plurality of slits 52*f* are provided and arranged in the arrow M direction along the shaft portion 45*a* (in the direction in which the shaft portion 45*a* extends). Incidentally, the shape, the number and the arrangement of the slits 52*f* are not limited thereto.

Parts (a) to (d) of FIG. 18 are plan views each showing modified examples of the constitutions of (a) to (d) of FIG. 11, respectively. In the constitutions in FIG. 18, the plurality of slits 52*f* and the plurality of projections 45*c* and a plurality of projections 45*b* of the rotatable member 45 are disposed to establish the non-overlapping position relationship with respect to the arrow M direction along the shaft portion 45*a* (with respect to the direction in which the shaft portion 45*a* extends). The plurality of slits 52*f* are provided and arranged in the arrow M direction along the shaft portion 45*a* (in the direction in which the shaft portion 45*a* extends). Incidentally, the shape, the number and the arrangement of the slits 52*f* are not limited thereto.

Parts (a) to (d) of FIG. 12 are plan views each showing a seal member 52 in a modified embodiment of Embodiment 3. As shown in FIG. 12, each slit 52*f* may also be provided at an end portion thereof with an end portion hole 52*g* as a hole connected with the slit 52*f*. As a result, a force is exerted on the seal member 52 during peeling of the seal member 52, whereby it is possible to prevent breaking of the seal member 52 from the end portion of the slit 52*f*. Incidentally, the end portion holes 52*g* and the projections 45*c* are disposed to establish the non-overlapping positional relationship with respect to the direction along the shaft portion 45*a*.

Parts (a) to (d) of FIG. 19 are plan views showing modified examples of the constitutions of (a) to (d) of FIG. 12, respectively. In the constitutions of FIG. 19, the end portion holes 52*g* and the projections 45*c* and projections 45*b* of the rotatable member 45 are disposed to establish the non-overlapping positional relationship with respect to the direction along the shaft portion 45*a*.

Parts (a) and (b) of FIG. 13 are sectional views each showing a state of the developing unit during image formation. As shown in (c) of FIG. 11, in the case where an open portion of the U-shape o the slit 52*f* is directed toward the sealing portion 24, during the image formation, as shown in (a) of FIG. 13, there is a possibility that the tongue piece 52*h* of the seal member 52 opens outward due to a resistance of the toner. The outward open portion is subjected to the resistance of the toner when the rotatable member 45 is rotated. Incidentally, this is true for the cross-shape ((a) of FIG. 11) and the H-shape ((b) of FIG. 11).

Here, the open portion of the U-shape is disposed in the rotation member 45 side as shown in (d) of FIG. 11. In this case, the slits 52*f* and 52*h* are formed in the U-shape which opens toward the connecting portion 52J2. As a result, as shown in (b) of FIG. 13, the tongue pieces 52*h* are readily wound about the projections 45*c*, so that the resistance of the toner when the rotatable member 45 is rotated can be reduced.

Parts (a) and (b) of FIG. 14 are sectional views each showing a state of the developing unit during peeling of the sealing portion 24 in the case where the slit has the U-shape ((d) of FIG. 11). Here, the peeling of the sealing portion 24 will be described with reference to FIG. 14.

As shown in (a) of FIG. 14, a toner range in which the toner is pushed away by the seal member 52 in a period from start of the unsealing of the first sealing portion 24*a* to the state of (b) of FIG. 14 by rotation of the rotatable member 45 is X.

As shown in (b) of FIG. 14, the tongue piece 52*h* provided to the seal member 52 opens due to the toner resistance during unsealing of the sealing portion 24, so that the toner can pass through the tongue piece 52*h*. As a result, the amount of the toner, represented by X, pushed away by the seal member 52 becomes small when compared with the case where there is no slit 52*f*, and therefore a force V (not shown) for pushing away the toner becomes small. For that reason, as described above, a force W required during the unsealing of the sealing portion 24 can be reduced, so that a torque for rotating the rotatable member 45 can be reduced.

According to the constitutions in Embodiments 1 to 3, the seal member 52 is provided with the holes 52*c* or the slits 52*f*, whereby the load required for unsealing the seal member 52 from the peripheral wall of the opening 27 of the developing container 99 is decreased. In the case where the seal member is unsealed, to the unsealing member, a load for peeling the seal member and a load for pushing away the toner in the neighborhood of the seal member are applied. However, of these loads, the load for pushing away the toner is decreased.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 017477/2013 filed Jan. 31, 2013 and 246516/2013 filed Nov. 28, 2013, which are hereby incorporated by reference.

What is claimed is:

1. A developer container comprising:

an accommodating chamber for accommodating developer, the accommodating chamber being provided with an opening;

a seal member for unsealably sealing the opening, the seal member including a hole; and a rotatable member rotatably supported inside of the accommodating chamber, wherein the rotatable member includes a shaft portion and a projection extending in a radial direction of the shaft portion, the projection being configured to wind up the seal member when the shaft portion rotates, and wherein the hole and the projection are provided in a non-overlapping positional relationship with respect to a longitudinal direction along the shaft portion.

2. A developer container according to claim 1, wherein, when the rotatable member rotates, the seal member is wound up around the shaft portion and the projection.

3. A process cartridge detachably mountable to a main assembly of an image forming apparatus, the process cartridge comprising:

a developer container according to claim 1, wherein the developer container includes:

a developing chamber including a developer carrying member for feeding developer to a surface of a photosensitive member.

4. An image forming apparatus comprising:

an image forming portion for forming an image; and a developer container according to claim 1.

5. A developer container according to claim 1, wherein the seal member includes a plurality of holes, and wherein, when the seal member is unsealed, the plurality of holes are positioned between the rotatable member and the opening.

6. A developer container according to claim 1, wherein the accommodating chamber includes:

an inclined surface descending toward the opening;

a recessed portion recessed at a position closer to the opening than the inclined surface; and a vibrating sheet, provided on the inclined surface, to which vibration is applied by contact with the seal member.

7. A developer container according to claim 6, wherein the vibrating sheet is projected at an end portion thereof from the inclined surface toward the opening.

8. A developer container according to claim 1, further comprising a vibrating sheet provided inside of the developer container, wherein the seal member includes a plurality of holes, and wherein developer on the vibrating sheet can move toward the opening through the plurality of holes while the vibrating sheet contacts the seal member.

9. A developer container according to claim 1, wherein the rotatable member includes a plurality of projections, and extended ends of the plurality of projections are contactable with the seal member when the rotatable member rotates.

10. A developer container according to claim 1, wherein the seal member includes a first sealing portion located at an upstream side of the opening with respect to a rotational direction of the rotatable member and a second sealing portion located at a downstream side of the opening with respect to the rotational direction of the rotatable member.

11. A developer container according to claim 10, wherein, when the sealing member is unsealed, the first sealing portion is unsealed before the second sealing portion is unsealed.

12. A developer container according to claim 1, wherein the seal member includes a plurality of holes, and wherein, when the seal member is wound up around the shaft portion and the projection, the developer moves toward outside of the seal member through the plurality of holes.

13. A developer container according to claim 1, further comprising a feeding sheet provided on the rotatable member.

14. A developer container according to claim 13, wherein the seal member is fixed between the feeding sheet and the rotatable member.

15. A developer container according to claim 1, wherein the rotatable member includes a plurality of projections, and wherein the plurality of projections has an outer configuration larger than the shaft portion as seen from a longitudinal direction of the rotatable member.

16. A developer container according to claim 1, wherein the rotatable member includes a plurality of projections and the seal member includes a plurality of holes, and wherein the plurality of projections does not bite into the plurality of holes.

17. A developer container comprising:

an accommodating chamber for accommodating developer, the accommodating chamber being provided with an opening;

a seal member for unsealably sealing the opening, the seal member including a slit; and a rotatable member rotatably supported inside of the accommodating chamber, wherein the rotatable member includes a shaft portion and a projection extending in a radial direction of the shaft portion the projection being configured to wind up the seal member when the shaft portion rotates, and wherein the slit and the projection are provided in a non-overlapping positional relationship with respect to a longitudinal direction along the shaft portion.

18. A developer container according to claim 17, wherein, when the rotatable member rotates, the seal member is wound up around the shaft portion and the projection.

19. A developer container according to claim 17, wherein the seal member includes a plurality of slits and each slit of the plurality of slits is formed in a U-shape that opens toward a connecting portion of the seal member.

20. A developer container according to claim 17, wherein the seal member includes a plurality of slits and each slit of the plurality of slits is connected with a hole at an end thereof, and wherein the rotating member includes a plurality of projections, with each hole and with each projection being provided in a non-overlapping positional relationship with respect to the longitudinal direction along the shaft portion.

21. A developer container according to claim 17, wherein the accommodating chamber includes:

an inclined surface descending toward the opening;

a recessed portion recessed at a position closer to the opening than the inclined surface; and a vibrating sheet, provided on the inclined surface, to which vibration is applied by contact with the seal member.

22. A developer container according to claim 21, wherein the vibrating sheet is projected at an end portion thereof from the inclined surface toward the opening.

23. A developer container according to claim 17, wherein the seal member includes a plurality of slits, and wherein, when the seal member is unsealed, the plurality of slits are positioned between the rotatable member and the opening.

24. A process cartridge detachably mountable to a main assembly of an image forming apparatus, the process cartridge comprising:

a developer container according to claim 17, wherein the developer container includes:

a developing chamber including a developer carrying member for feeding developer to a surface of a photosensitive member.

25. An image forming apparatus comprising:

an image forming portion for forming an image; and a developer container according to claim 17.

26. A developer container according to claim 17, further comprising a vibrating sheet provided inside of the developer container, wherein the seal member includes a plurality of slits, and wherein developer on the vibrating sheet can move toward the opening through the plurality of slits while the vibrating sheet contacts the seal member.

27. A developer container according to claim 17, wherein the rotatable member includes a plurality of projections, and extended ends of the plurality of projections are contactable with the seal member when the rotatable member rotates.

28. A developer container according to claim 17, wherein the seal member includes a first sealing portion located at an upstream side of the opening with respect to a rotational direction of the rotatable member and a second sealing portion located at a downstream side of the opening with respect to the rotational direction of the rotatable member.

29. A developer container according to claim 28, wherein, when the sealing member is unsealed, the first sealing portion is unsealed before the second sealing portion is unsealed.

30. A developer container according to claim 17, wherein the seal member includes a plurality of slits, and wherein, when the seal member is wound up around the shaft portion and the projection, the developer moves toward outside of the seal member through the plurality of slits.

31. A developer container according to claim 17, further comprising a feeding sheet provided on the rotatable member.

32. A developer container according to claim 31, wherein the seal member is fixed between the feeding sheet and the rotatable member.

33. A developer container according to claim 17, wherein the rotatable member includes a plurality of projections, and wherein the plurality of projections has an outer configuration larger than the shaft portion as seen from a longitudinal direction of the rotatable member.

34. A developer container according to claim 17, wherein the rotatable member includes a plurality of projections and the seal member includes a plurality of slits, and wherein the plurality of projections does not bite into the plurality of slits.

35. A developer container comprising:

an accommodating chamber for accommodating developer, the accommodating chamber being provided with an opening;

a seal member for unsealably sealing the opening, the seal member including a hole;

a rotatable member rotatably supported inside of the accommodating chamber; and a vibrating sheet provided inside of the developer container, wherein the rotatable member includes a shaft portion and a projection extending in a radial direction of the shaft portion, and wherein the hole and the projection are provided in a non-overlapping positional relationship with respect to a direction along the shaft portion, wherein the seal member includes a connecting portion connected with the rotatable member and an interconnecting portion having the hole, and wherein the vibrating sheet is contactable with the interconnecting portion so that the developer is moved toward the opening and passes through the interconnecting portion.

36. A developer container comprising:

an accommodating chamber for accommodating developer, the accommodating chamber being provided with an opening;

a seal member for unsealably sealing the opening, the seal member including a slit;

a rotatable member rotatably supported inside of the accommodating chamber; and a vibrating sheet provided inside the developer container, wherein the rotatable member includes a shaft portion and projection extending in a radial direction of the shaft portion, with the projection being configured to wind up the seal member when the shaft portion rotates, wherein the slit and the projection are provided in a non-overlapping positional relationship with respect to a direction along a longitudinal direction of the shaft portion, wherein the seal member includes a connecting portion connected with the rotatable member and an interconnecting portion having the slit, and wherein the vibrating sheet is contactable with the interconnecting portion so that the developer is moved toward the opening and passes through the interconnecting portion.

* * * * *